US011559988B2

(12) United States Patent
Chen et al.

(10) Patent No.: US 11,559,988 B2
(45) Date of Patent: Jan. 24, 2023

(54) COMPENSATION METHOD AND DEVICE FOR NOZZLE IN INKJET PRINTER AND INKJET PRINTER

(71) Applicant: SHENZHEN HOSONSOFT CO., LTD, Guangdong (CN)

(72) Inventors: Yan Chen, Guangdong (CN); Zhongkun Huang, Guangdong (CN); Shubo Su, Guangdong (CN); Jianping Ren, Guangdong (CN)

(73) Assignees: SENDA (SHENZHEN) TECHNOLOGY CO., LTD., Guangdong (CN); SHENZHEN HOSONSOFT CO., LTD, Guangdong (CN)

( * ) Notice: Subject to any disclaimer, the term of this patent is extended or adjusted under 35 U.S.C. 154(b) by 0 days.

(21) Appl. No.: 16/960,880

(22) PCT Filed: Jan. 16, 2019

(86) PCT No.: PCT/CN2019/071923
§ 371 (c)(1),
(2) Date: Jul. 8, 2020

(87) PCT Pub. No.: WO2019/141181
PCT Pub. Date: Jul. 25, 2019

(65) Prior Publication Data

US 2021/0053346 A1 Feb. 25, 2021

(30) Foreign Application Priority Data

Jan. 17, 2018 (CN) ..... 201810046390.4
Jan. 17, 2018 (CN) ..... 201810046393.8
(Continued)

(51) Int. Cl.
*B41J 2/12* (2006.01)
*B41J 2/045* (2006.01)
(Continued)

(52) U.S. Cl.
CPC ..... *B41J 2/12* (2013.01); *B41J 2/0451* (2013.01); *B41J 2/125* (2013.01); *B41J 2/165* (2013.01); *B41J 29/38* (2013.01)

(58) Field of Classification Search
CPC ..... B41J 2/0451; B41J 2/125; B41J 2/165
See application file for complete search history.

(56) References Cited

FOREIGN PATENT DOCUMENTS

CN 1191934 C 3/2005
CN 1287988 C 12/2006
(Continued)

*Primary Examiner* — Lam S Nguyen

(57) ABSTRACT

A compensation method includes determining position information of an abnormal nozzle of an inkjet head; acquiring printing parameters, determining first data corresponding to the abnormal nozzle, and based on the position information of the abnormal nozzle and the printing parameters, determining position information of a compensation nozzle for compensating the first data corresponding to the abnormal nozzle; and based on the printing parameters, acquiring second data of the compensation nozzle in a normal printing state which includes ink out data and ink holding data, determining an address of the ink holding data, and generating compensation data by writing the first data into the address of the ink holding data. A compensation device includes: an abnormal nozzle position determination module; a compensation nozzle position determination module; and a compensation data generation module. An inkjet printer includes: a controlling unit, an inkjet head unit, and a nozzle compensation unit.

6 Claims, 15 Drawing Sheets

(30) Foreign Application Priority Data

Jan. 17, 2018 (CN) ..... 201810046981.1
Jan. 17, 2018 (CN) ..... 201810047077.2

(51) Int. Cl.
*B41J 2/125* (2006.01)
*B41J 2/165* (2006.01)
*B41J 29/38* (2006.01)

(56) References Cited

FOREIGN PATENT DOCUMENTS

| | | | |
|---|---|---|---|
| CN | 100396490 | C | 6/2008 |
| CN | 101372180 | A | 2/2009 |
| CN | 100513175 | C | 7/2009 |
| CN | 100548682 | C | 10/2009 |
| CN | 1939729 | B | 10/2010 |
| CN | 105479945 | A | 4/2016 |
| CN | 104441997 | B | 8/2016 |

COMPENSATION METHOD AND DEVICE FOR NOZZLE IN INKJET PRINTER AND INKJET PRINTER

TECHNICAL FIELD

The present invention generally relates to inkjet printing technologies, and more particularly, to a compensation method and a device for abnormality of a nozzle in an inkjet printer, and an inkjet printer using the method and with the device above.

BACKGROUND

An inkjet printer ejects ink drops onto a printing medium from a nozzle of an inkjet head to form an image or a word. The inkjet printer may perform the printing process through a shuttle scanning printing, a single scanning printing, or a multiple inkjet heads in parallel scanning printing, etc. The shuttle scanning printing is also called multiple-pass scanning printing which indicates that each unit of the to-be-printed image is printed by multiple interpolations, and each unit is formed by multiple image pixels. For example, a 2-pass scanning printing indicates that each unit of the to-be-printed image is formed by two pixels, a 3-pass scanning printing indicates that each unit of the to-be-printed image is formed by three pixels. The single scanning printing is also called single-pass scanning printing which indicates that each unit of the to-be-printed image is printed by one scanning. The multiple inkjet heads in parallel scanning printing is also called one-pass scanning printing which indicates that the to-be-printed image is printed by one printing.

As shown in FIG. 1, which is a schematic view of a 4-pass scanning printing, an area A (or a block of image) of the to-be-printed image needs to be printed by 4 times of covering printing. The area A is formed by a plurality of units B, and each unit B is formed by four pixels. Data of the area A is divided into a data block A1, a data block A2, a data block A3, and a data block A4, and the four data blocks are respectively printed by different nozzles of the inkjet head. A moving direction of the printing medium is L1 as shown in FIG. 1, and a moving direction of the inkjet head is Z1 as shown in FIG. 1. When the inkjet head is in the first pass, the data block A1 is printed by a part J1 of the inkjet head, and a moving distance of the printing medium is equal to a length of the part J1 of the inkjet head in the direction L. When the inkjet head is in the second pass, the data block A2 is printed by a part J2 of the inkjet head, and the printing medium further moves for a distance equal to a length of the part A2 of the inkjet head. When the inkjet head is in the third pass, the data block A3 is printed by a part J3 of the inkjet head, and the printing medium further moves for a distance equal to a length of the part J3. When the inkjet head is in the fourth pass, the data block A4 is printed by a part J4 of the inkjet head. Thus, the area A of the to-be-printed image is printed through four times of covering printing by different parts of the inkjet head.

Technical Problems

However, as shown in FIG. 2, if the inkjet printer works for a long time, the nozzle of the inkjet head may be abnormal due to contamination of the ink path, oblique jetting, ink sediment, dust, and moisture. The abnormality of the nozzle includes blocking, blurring, lack of ink, et al., which also may bring broken lines or blank spaces in the printed image and thus greatly affect the quality of the printed products.

In prior art, the nozzle is unblocked by cleaning, ink pressing, scraping or wiping, when the nozzle is abnormal. However, during the cleaning process, it may be difficult to erase some of the blocked nozzles thoroughly. The printer may be qualified at its lowest limit with several abnormal nozzles; however, for the printed product requiring high quality and high accuracy, the inkjet head needs to be replaced. If the number of the abnormal nozzles exceeds 10%, the inkjet head must be replaced. The replacement of the inkjet head caused by abnormality of only several nozzles not only delays the printing process, but also greatly increases the cost of the printing process.

SUMMARY OF THE PRESENT INVENTION

The present invention provides a compensation method and a device for nozzle abnormality of an inkjet printer and an inkjet printer for solving the problem mentioned above.

In one aspect, the present invention provides a compensation method for nozzle abnormality of an inkjet printer, including steps of:

determining position information of an abnormal nozzle in an inkjet head;

acquiring printing parameters, determining first data corresponding to the abnormal nozzle, and based on the position information of the abnormal nozzle and the printing parameters, determining position information of a compensation nozzle for compensating the first data corresponding to the abnormal nozzle; and acquiring second data of the compensation nozzle in a normal printing state based on the printing parameters which include ink out data and ink holding data, determining an address of the ink holding data, and generating compensation data by writing the first data into the address of the ink holding data.

Preferably, the printing parameters include a relative displacement between a printing medium and the inkjet head, the number of the nozzle, and printing times of a first shuttle scanning printing.

Preferably, the method further includes steps of: defining the printing times of the first shuttle scanning printing to be R wherein R is an integer greater than 2 and the inkjet head includes R groups of the nozzles; when a v-th group of the nozzles includes one or more abnormal nozzles, selecting one or more nozzles from remaining R-1 groups of the nozzles corresponding to the one or more abnormal nozzles as alternative compensation nozzles, and selecting the compensation nozzles from the alternative compensation nozzles to compensate the abnormal nozzles, wherein each abnormal nozzle corresponds to at least one compensation nozzle and v is an integer greater than 1.

Preferably, acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle includes steps of:

defining a parameter P as the printing times of the first shuttle scanning printing, which indicates each block of image is formed by P times of covering printing, wherein P is an integer equal to or greater than 2; defining X as a current printing index, which refers to current printing times counted from a beginning of a printing, performing calculation to determine whether all the abnormal nozzles are in a printing range of the P times of printing including a current printing; taking one of the abnormal nozzles as a 1st nozzle, a beginning printing position of the X-th printing as $S_x$ which is equal to the relative displacement between the printing medium and the inkjet head in previous X times of printing, a newly-increased covering distance on the printing medium of the X-th printing as $h_x$, and a height of the inkjet head as H, then a newly-increased covering range of the X-th printing being $[S_x+H-h_x, S_x+H]$; taking the distance between the 1st nozzles as W in the direction, along which the said nozzle has a relative increasing displacement against the printing medium, initial positions of an (x+0)-th, an (X+1)-th, . . . an (X+P−1)-th printing being respectively $S_x, S_{x+1}, \ldots, S_{X+P-1}$, and the newly-increased covering range of each printing being $[S_x+H-h_x, S_x+H]$, and the printing positions of the 1st nozzle being respectively $S_x+W$, $S_{x+1}+W, \ldots, S_{X+P-1}+W$; if the printing position of the 1st nozzle on the printing medium in not within the newly-increased covering range, a first mapping relationship is not stored; and if the printing position of the 1st nozzle on the printing medium is within the newly-increased covering range and is different from the stored first mapping relationship, storing the first mapping relationship, and extracting the first data of the 1st nozzle, wherein the first mapping relationship includes the corresponding printing index and the printing position of the 1st nozzle on the printing medium.

Preferably, acquiring the second data of the compensation nozzle in the normal printing state based on the printing parameters which include the ink out data and the ink holding data, determining the address of the ink holding data, and generating the compensation data by writing the first data into the address of the ink holding data includes steps of:

when a current printing is an X-th printing, individually searching the stored first mapping relationships and marking the abnormal nozzle corresponding to one of the mapping relationships as a 2nd nozzle, acquiring a printing position of the 2nd nozzle on the printing medium from the first mapping relationships; if the printing position of the 2nd nozzle is greater than an initial position of the current printing, determining that the first mapping relationship is valid; if $Z_x$ is less than H, determining that the first data corresponding to the 2nd nozzle is compensable, wherein $Z_x$ is obtained by subtracting the initial position of the current printing from the printing position of the 2nd nozzle; based on the position information of each nozzle in the inkjet head, if the nozzle corresponding to $Z_x$ is a normal nozzle, using the nozzle corresponding to $Z_x$ as the compensation nozzle of the 2nd nozzle and marking the nozzle corresponding to $Z_x$ as a 3rd nozzle; obtaining the compensation data of the 3rd nozzle by writing the first data of the 2nd nozzle into the address of the ink holding data of the second data corresponding to the 3rd nozzle, and erasing the data corresponding to the 2nd nozzle which has been written into the 3rd nozzle and has been compensated;

as the relative displacement between the printing medium and the inkjet head increases, third data, fourth data, and K-th data corresponding to the 2nd nozzle are continuously obtained until the data compensation of the 2nd nozzle is finished or the first mapping relationship of the 2nd nozzle is outdated, wherein the 3rd data is remaining to-be-compensated data after the second data is compensated, the fourth data is remaining to-be-compensated data after the third data is compensated, the K-th data is remaining to-be-compensated data after the (K−1)-th data is compensated, $4<K<P$ and K is an integer.

Preferably, before acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle, the method includes:

acquiring the printing parameters, and feathering the first data corresponding to the printing parameters to obtain second printing data, wherein the second printing data includes the first data and the second data.

Preferably, the printing parameters include a first feathering amplitude, and feathering the first data corresponding to the printing parameters to obtain the second printing data includes steps of:

obtaining printing times of a second shuttle scanning printing based on the printing times of the first shuttle scanning printing and the first feathering amplitude, wherein the printing times of the second shuttle scanning printing is greater than that of the first shuttle scanning printing; and feathering to-be-printed first printing data to obtain the second printing data based on the printing times of the second shuttle scanning printing, wherein a number of elements of the ink holding data in the second printing data is greater than that of elements of the ink holding data in the first printing data.

Preferably, acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle includes steps of:

if the current printing includes the abnormal nozzle, marking the abnormal nozzle as the first abnormal nozzle;

based on the printing parameters and a covering times of a same area on the printing medium in the current printing, acquiring a feeding distance covering the printing medium in the current printing and a compensation range for the first abnormal nozzle, building a second mapping relationship between a position of the first abnormal nozzle, a printing position of the first abnormal nozzle on the printing medium, and the first data corresponding to the first abnormal nozzle;

if the printing position of the first abnormal nozzle on the printing medium is outside a current printing range of the inkjet head, stopping storing the second matting relationship; and if the printing position of the first abnormal nozzle on the printing medium is within the current printing range of the inkjet head, storing the second matting relationship and backing up the first data.

Preferably, acquiring second data of the compensation nozzle in the normal printing state based on the printing parameters which includes the ink out data and the ink holding data, determining the address of the ink holding data, and generating the compensation data by writing the first data into the address of the ink holding data includes steps of:

searching the stored second mapping relationship to determine whether there is at least one of the abnormal nozzles except the first abnormal nozzle having a printing position thereof in the printing range of the current printing medium; and if there is at least one of the abnormal nozzles except the first abnormal nozzle having the printing position thereof in the printing rang of the current printing medium, marking the corresponding abnormal nozzle as the second abnormal nozzle and acquiring printing position information of the second abnormal nozzle on the printing medium based on the second mapping relationship, performing calculation to obtain the compensation nozzle in the printing range which covers the current printing medium, and generating the compensation data by writing the backup printing data of the second abnormal nozzle in the second mapping relationship into the address of the ink holding data of the compensation nozzle.

Preferably, the printing parameters further include a second feathering amplitude, the printing times of the first shuttle scanning printing is 1, and acquiring the printing parameters and feathering the first data corresponding to the printing parameters to obtain the second data includes step of:

based on the second feathering amplitude and the number of the nozzles, determining a printing overlapping area; and feathering the first data corresponding to the printing overlapping area to obtain the second printing data.

Preferably, the method further includes steps of:

defining a distance between the abnormal nozzle and a NO. 1 nozzle in a direction along which the relative displacement between the inkjet head and the printing medium is increased to T, the number of the nozzles to x1, the relative displacement to x2, and a nozzle number corresponding to the printing overlapping area to r;

if T is less than or equal to r, a distance Y between the compensation nozzle and the NO. 1 nozzle is:

$$Y=T+x2;$$

for an m-th printing, acquiring the first data corresponding to the abnormal nozzle from the second printing data corresponding to the m-th printing; based on the position information of the compensation nozzle, obtaining the second data corresponding to the compensation nozzle from the second printing data corresponding to an (m−1)-th printing, and generating the compensation data by writing the first data into the address of the ink holding data in the second data;

if T≥x2, the distance Y between the compensation nozzle and the NO. 1 nozzle in the direction along which the relative displacement between the inkjet head and the printing medium is increased is:

$$Y=T-x2;$$

for the m-th printing, obtaining the first data corresponding to the abnormal nozzle from the second printing data corresponding to the m-th printing; based on the position information of the compensation nozzle, obtaining the second data corresponding to the compensation nozzle from the second printing data corresponding to an (m+1)-th printing, and generating the compensation data by writing the first data into the address of the ink holding data in the second data;

Preferably, the printing parameters include a first nozzle number of two adjacent overlapping nozzle area and a second nozzle number of a single inkjet head.

Preferably, acquiring the printing parameters and feathering the first data corresponding to the printing parameters to obtain the second data includes:

based on the first printing data corresponding to the overlapping nozzle area, acquiring feathering data corresponding to a feathering template and complementary data of the feathering data, performing a logical AND operation between the first printing data and the feathering data to obtain first feathering data, performing a logical AND operation between the first printing data and the complementary feathering data to obtain second feathering data, and combining the first feathering data and the second feathering data to form the second printing data.

Preferably, the complementary feathering data is obtained through the following formula:

$$P'=E-P;$$

wherein E is data corresponding to an unit matrix of which elements are 1, P' is the complementary feathering data, and P is the feathering data.

Preferably, by defining the number of the nozzles to be n, for a m-th inkjet head, when m=1, the first inkjet head includes one overlapping nozzle area which is marked as a first overlapping nozzle area; the first inkjet head further includes a first non-overlapping nozzle area; a nozzle number corresponding to the first overlapping nozzle are is marked as a first overlapping nozzle number, a nozzle number corresponding to the first non-overlapping nozzle is marked as a first non-overlapping nozzle number; when 1<m<n, the m-th inkjet head includes two overlapping nozzle areas which are respectively a second overlapping nozzle area and a third overlapping nozzle area, a nozzle number corresponding to the second overlapping nozzle area is marked as a second overlapping nozzle number, and a nozzle number corresponding to the third overlapping nozzle area is marked as a third overlapping nozzle number;

for an X-th abnormal nozzle in the m-th inkjet head wherein X is a natural number greater than 0, when a serial number X of the abnormal nozzle is less than or equal to the second overlapping nozzle number of the m-th inkjet head, the compensation nozzle for compensating the printing data corresponding to the abnormal nozzle is located in an (m−1)-th inkjet head, and a serial number of the compensation nozzle is obtained through the following formula:

$$Y=X+D+Z;$$

wherein Y is the serial number of the compensation nozzle, X is the serial number of the abnormal nozzle, D is the second non-overlapping nozzle number of the (m−1)-th nozzle, and Z is the second overlapping nozzle number of the (m−1)-th nozzle;

when the serial number X of the abnormal nozzle is greater than or equal to a sum of the second overlapping nozzle number and the second non-overlapping nozzle number of the m-th inkjet head, the compensation nozzle for compensating the printing data corresponding to the abnormal nozzle is located in an (m+1)-th inkjet head, and the serial number of the compensation nozzle can be obtained through the following formula:

$$Y=X-T-U;$$

wherein Y is the serial number of the compensation nozzle, X is the serial number of the abnormal nozzle, T is the second non-overlapping nozzle number of the m-th nozzle, and U is the second overlapping nozzle number of the m-th nozzle.

Preferably, determining position information of the abnormal nozzle of the inkjet head includes steps of:

obtaining an arrangement of the nozzles and generating a reference nozzle state view based on the arrangement of the nozzles;

acquiring reference image data corresponding to the reference nozzle state view, and acquiring an actual nozzle state view by controlling the inkjet head to jet ink on a printing medium based on the reference image data; and determining a position of the abnormal nozzle according to the actual nozzle state view and the reference nozzle state view.

Preferably, before acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle, the method further includes:

based on the position information of the abnormal nozzle, determining an printing data address of the first data, and writing the ink holding data into the printing data address corresponding to the first data.

Preferably, determining the position information of the abnormal nozzle of the inkjet head includes steps of:

sending a first detection signal, controlling each nozzle in the inkjet head to jet ink to obtain a first feedback signal corresponding to each nozzle after the first detection signal passes through a preset jetting trail of the corresponding nozzle, wherein the preset jetting trail is a moving trail along which the nozzle jet ink when the nozzle is normal;

sending a second detection signal, controlling each nozzle in the inkjet head to jet ink to obtain a second feedback signal corresponding to each nozzle after the second detection signal passes through a preset jetting trail of the corresponding nozzle; and determining the position information of the abnormal nozzle in the inkjet head according to the first feedback signal and the second feedback signal.

According to a second aspect, the present invention provides a compensation device for nozzle abnormality of an inkjet printer, including:

an abnormal nozzle position determination module for determining position information of the abnormal nozzle in an inkjet head;

a compensation nozzle position determination module, configured for acquiring printing parameters, determining first data corresponding to the abnormal nozzle, and based on the position information of the abnormal nozzle and the printing parameters, determining position information of a compensation nozzle for compensating the first data of the abnormal nozzle; and a compensation data generation module, configured for, based on the printing parameters, acquiring second data of the compensation nozzle in a normal printing data wherein the second data includes ink out data and ink holding data, determining an address of the ink holding data in the second data, and generating compensation data by writing the first data into the address of the ink holding data.

According to a third aspect, the present invention provides an inkjet printer, including a controlling unit, an inkjet head unit, and a nozzle compensation unit; wherein the controlling unit controls the nozzle compensation unit such that the nozzle compensation unit compensates an abnormal nozzle in the inkjet head unit, wherein the nozzle compensation unit is a compensation device for nozzle abnormality as provided in the second aspect.

Beneficial Effect

The compensation method and device for nozzle abnormality of an inkjet printer and the inkjet printer provided in the present invention not only overcome the problem that the quality of the printed image is poor due to the abnormal nozzle, but also reduce the maintenance cost of the inkjet head.

DETAILED DESCRIPTION OF PREFERRED EMBODIMENTS

Features and exemplary embodiments of various aspects of the present invention will be described in below. In order to make the objectives, technical solutions, and advantages of the present invention clearer, the present invention will be further illustrated with reference to the accompanying drawings and embodiments. It should be understood that the specific embodiments described herein are only to explain the present invention, but not to be limiting. For those skilled in the art, the present invention may be implemented without some of these specific details. The following description of the embodiments is merely to provide a better understanding of the present invention by showing examples thereof.

It should be noted that, in this specification, terms like "first" and "second" are only used to differentiate one entity or operation from another, but are not necessarily used to indicate any practical relationship or order between these entities or operations. Moreover, a term such as "include", "contain" or any variation of the term means "including but not limited to". Therefore, a process, method, object, or device that includes a series of elements not only includes these elements, but also includes other elements that are not specified expressly, or may further include inherent elements of the process, method, object or device. In the case that there are no more limitations, in the context of a element that is specified by "include one . . . ", the process, method, object or device that includes a specified element may include other identical elements.

Figure 1:
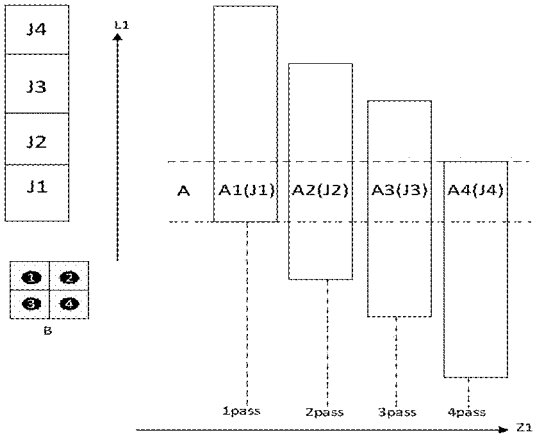
FIG. 1 (prior art)
FIG. 1 is a schematic view showing the working principle of a 4-pass scanning printing of a shuttle scanning printing of a conventional inkjet printer.
Figure 2:
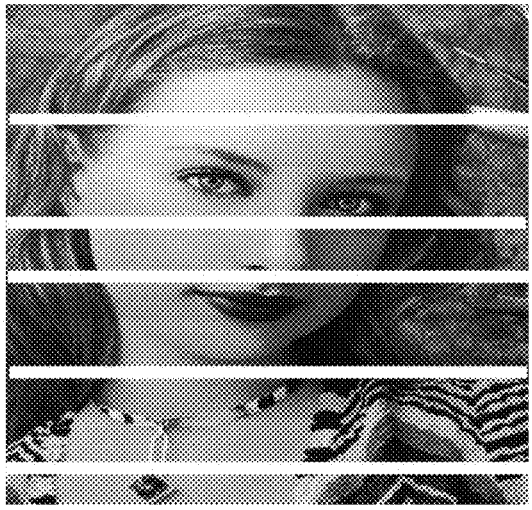
FIG. 2 (prior art)
FIG. 2 is a schematic view showing the printing effect of the inkjet printer of FIG. 1.
Figure 3:
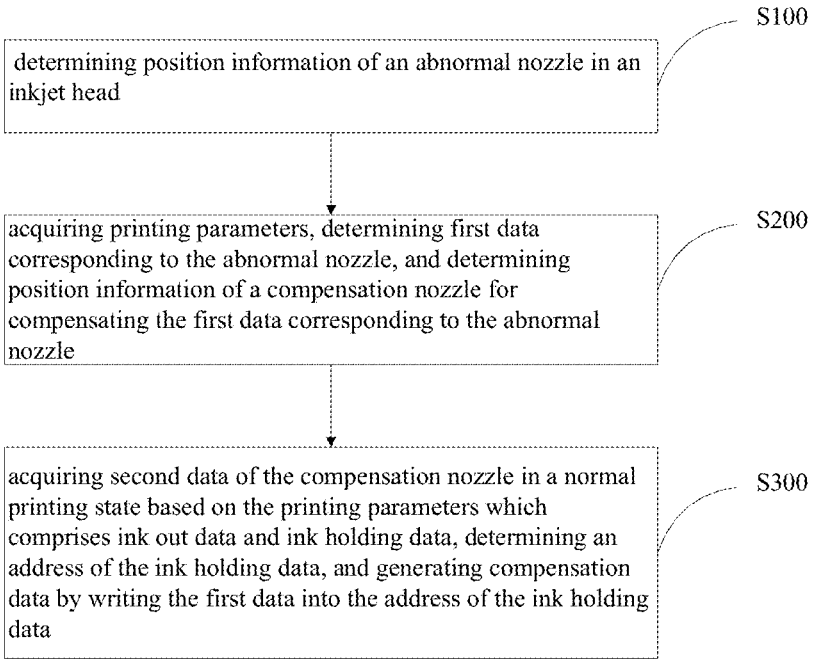
FIG. 3 is a flow chart of a compensation method for nozzle abnormality of an inkjet printer in accordance with a best mode of the present invention.

Referring to FIG. 3, the present invention provides a method for compensating an abnormal nozzle of an inkjet printer. The method can perform compensation when a nozzle of the inkjet printer is abnormal such that an image can be normally printed and imaging quality of the image on a printing medium is not degraded. The method includes steps as follows.

In step S100, determining position information of an abnormal nozzle in an inkjet head.

Figure 4:
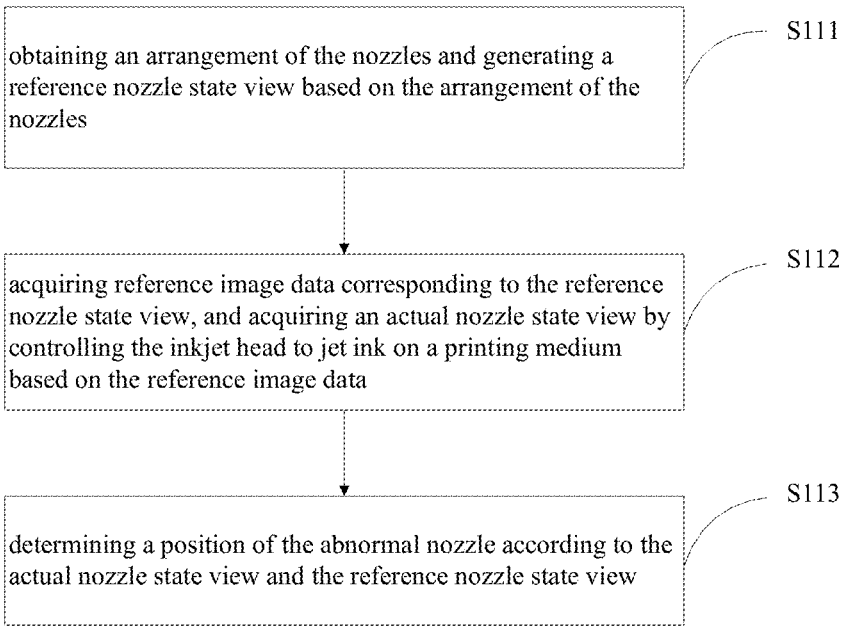
FIG. 4 is a flow chart showing how to determine a position of the abnormal nozzle of the method of FIG. 3.

As shown in FIG. 4, in an embodiment, the position information of the abnormal nozzle in the inkjet head can be determined through a printing state view, including steps as follows.

In step S111, obtaining an arrangement of nozzles and generating a reference nozzle state view based on the arrangement of the nozzles.

In step S112, acquiring reference image data corresponding to the reference nozzle state view, and acquiring an actual nozzle state view by controlling the inkjet head to jet ink on the printing medium based on the reference image data.

In step S113, determining a position of the abnormal nozzle according to the actual nozzle state view and the reference nozzle state view.

Figure 5:
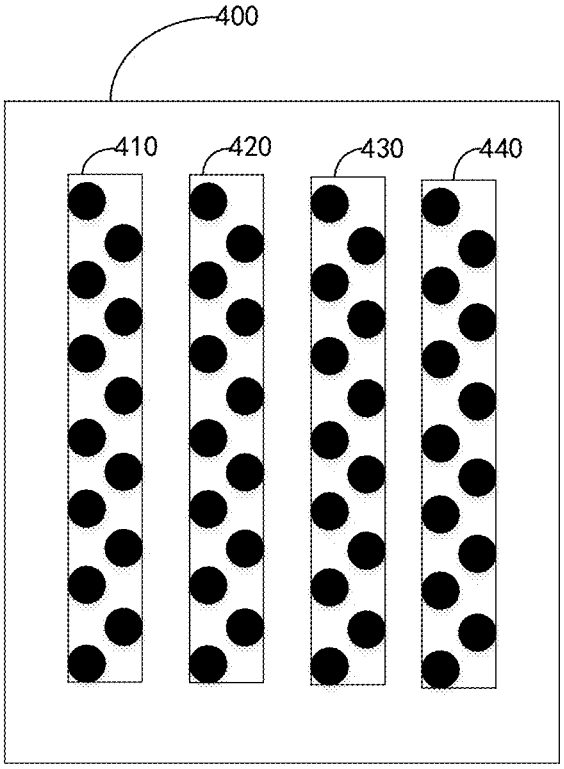
FIG. 5 is a schematic view showing an inkjet head used in the compensation method for nozzle abnormality of an inkjet printer in accordance with a best mode of the present invention.

Referring to FIG. 5, in an embodiment, the inkjet head 400 includes four passes, namely, a first pass 410, a second pass 420, a third pass 430, and a fourth pass 440. Each pass is capable of printing one color. Each pass is arranged with a plurality of nozzles. Assumed that each pass is arranged with V nozzles, when all the nozzles are normal, the printing state view is formed by 4V line segments and each has a position mark. Each line segment is independently formed by the printing performed by the corresponding nozzle. When there is one abnormal nozzle in the inkjet head 400, the corresponding line segment is obviously missed in the printing state view, thus, the position of the abnormal nozzle can be obtained according to the position mark of the missed line segment. In another embodiment, the printer is mounted with many inkjet heads 400 and each can print one color and has one pass. In yet another embodiment, each pass of the printer is formed by many inkjet heads and each pass can print one color. The method for determining the position information of the abnormal nozzle is applicable in any inkjet head.

Figure 6:
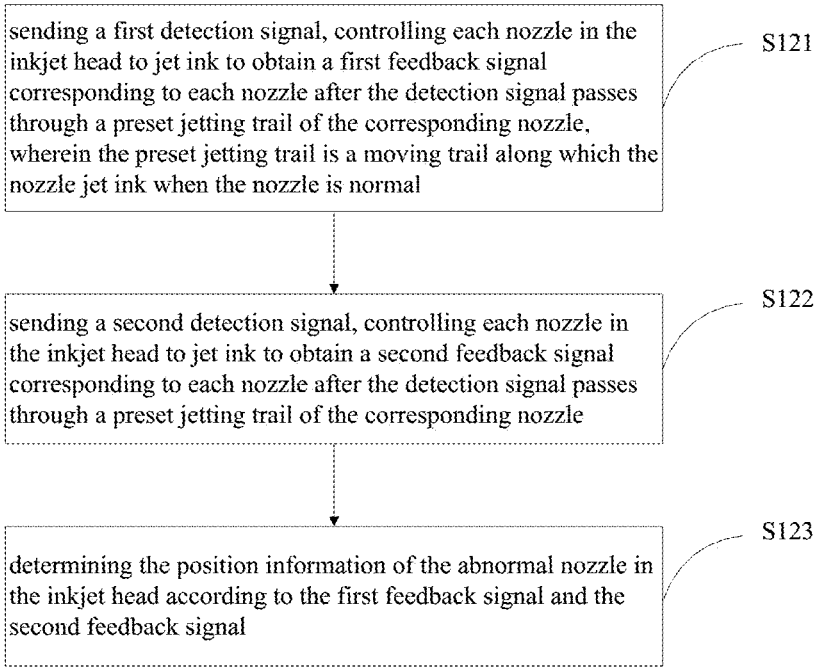
FIG. 6 is a flow chart showing how to determine the position of the abnormal nozzle of the method of FIG. 3.

Referring to FIG. 6, in another embodiment, the position information of the abnormal nozzle in the inkjet head can be determined through a sensor, including steps as follows.

In step S121, sending a first detection signal, controlling each nozzle in the inkjet head to jet ink to obtain a first feedback signal corresponding to each nozzle after the first detection signal passes through a preset jetting trail of the corresponding nozzle, wherein the preset jetting trail is a moving trail when the nozzle is normal.

In step S122, sending a second detection signal, controlling each nozzle in the inkjet head to jet ink to obtain a second feedback signal corresponding to each nozzle after the second detection signal passes through a preset jetting trail of the corresponding nozzle.

In step S123, determining the position information of the abnormal nozzle in the inkjet head according to the first feedback signal and the second feedback signal.

In an embodiment, two laser light beams are emitted by two sensors for detecting the abnormal nozzle. The position information of the abnormal nozzle is determined by the first feedback signal from the first sensor and the second feedback signal from the second sensor, thus, misjudgment caused by inaccurate detection due to detection error of the sensor can be avoided and the abnormal nozzle can be prevented from affecting the printing quality. Meanwhile, in some embodiments, the number of the sensors can be increased to improve the detection speed and the detection accuracy. The number of the sensors can be adjusted according to multi-requirements.

The above method is not only capable of determining the position information of the abnormal nozzle, but also is capable of determining the other abnormal state of the nozzle, such as blocking, oblique jetting, blurring, and lack of ink. When there is oblique jetting, blurring, or lack of ink, if the abnormal nozzle is kept on, the abnormal nozzle may keep jetting ink to contaminate the printing image which thus causes uneven ink drop density on the printing image, thus, the abnormal nozzle needs to be turned off before the compensation is performed. The method for turning off the abnormal nozzle includes:

obtaining the position information of the abnormal nozzle, determining a printing data address of first data, and writing ink holding data into the printing data address of the first data. Thus, the abnormal nozzle can be prevented from jetting ink during printing to avoid contamination of the printing image.

In step S200, acquiring printing parameters, determining first data corresponding to the abnormal nozzle, and determining position information of a compensation nozzle for compensating the first data corresponding to the abnormal nozzle.

In an embodiment, the printing parameters include a relative displacement between the printing medium and the inkjet head, a number of the nozzles, and printing times of a first shuttle scanning printing. The printing times of the first shuttle scanning printing indicates covering times of a unit area on the printing medium, namely the number of the pass which is an integer greater than 2 or equal to 2. The movement of the printing medium or the inkjet head after each scanning of the inkjet head (one pass of printing), namely the relative displacement between the printing medium and the inkjet head is marked as a paper feeding distance. When the number of the nozzles is equal to that of the nozzles in one pass, the printing times of the first shuttle scanning printing can be obtained by characteristics of the printing apparatus in the printing parameters and printing requirements of a to-be-printed image, wherein the characteristics of the printing apparatus include an accuracy of a single inkjet head and an accuracy of a lateral grating of the printer, and the printing requirements of the to-be-printed image include an accuracy of the to-be-printed image along a paper feeding direction and an accuracy of the to-be-printed image along a direction perpendicular to the paper feeding direction.

The printing times of the first shuttle scanning printing can be obtained through the following formula:

$$y1 = \frac{x_1}{x_3} \times \frac{x_2}{x_4}$$

wherein y1 is the printing times of the first shuttle scanning printing, $x_1$ is the accuracy of the to-be-printed image along the paper feeding direction, $x_2$ is the accuracy of the to-be-printed image along the direction perpendicular to the paper feeding direction, $x_3$ is the accuracy of the single inkjet head, $x_4$ is the accuracy of the lateral grating of the printing apparatus, and y, $x_1$, $x_2$, $x_3$, and $x_4$ are integers greater than 0.

The paper feeding distance (the relative displacement between the printing medium and the inkjet head) can be obtained through the following formula:

$$z = \frac{x_5}{y}$$

wherein z is the paper feeding distance, $x_5$ is the number of nozzles of one pass, y is the printing times of the first shuttle scanning printing, and z and $x_5$ are both integers greater than 0.

In some embodiments, determining the position information of the compensation nozzle includes: defining the printing times of the first shuttle scanning printing to be R which is an integer greater than 2, the inkjet head to correspondingly include R groups of the nozzles; when a v-th group of the nozzles includes one or more abnormal nozzles, selecting one or more nozzles form the remaining R-1 groups of the nozzles corresponding to the one or more abnormal nozzles as alternative compensation nozzles, and selecting the compensation nozzle from the alternative compensation nozzles to compensate the abnormal nozzle, and each abnormal nozzle corresponding to at least one compensation nozzle, wherein v is an integer greater than 1.

Figure 7:
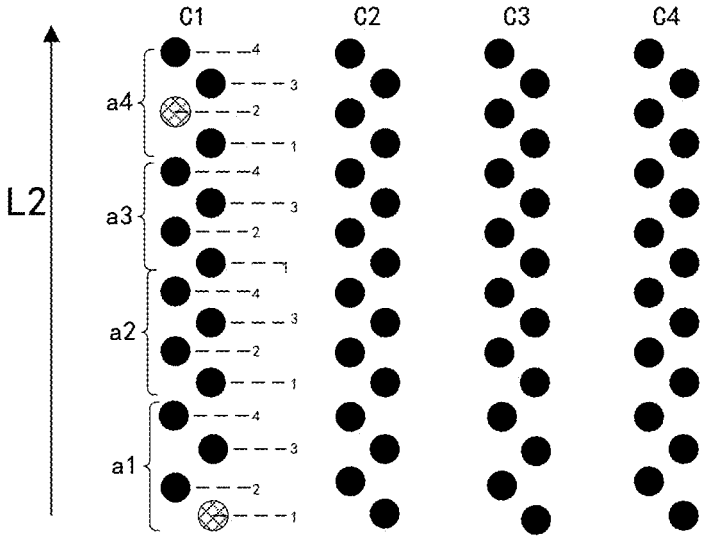
FIG. 7 is a schematic view showing how to determine a position of a compensation nozzle of the compensation method for nozzle abnormality of an inkjet printer in accordance with a best mode of the present invention.

As shown in FIG. 7, the inkjet head includes 4 passes which are a black pass C1, a green pass C2, a magenta pass C3, and a yellow pass C4. Each pass has 16 nozzles. Taken the 4-pass printing as an example, the nozzles of the black pass C1 are evenly divided into four groups, including a first group a1, a second group a2, a third group a3, and a fourth group a4. Each group of nozzles include four nozzles which are arranged in turn along the paper feeding direction as a first nozzle, a second nozzle, a third nozzle, and a fourth nozzle. The abnormal nozzles are the first nozzle of the first group a1 and the second nozzle of the fourth group a4, then, the compensation nozzles for the first nozzle of the first group a1 include the first nozzle of the second group a2, the first nozzle of the third group a3, and the first nozzle of the fourth group a4; and the compensation nozzles for the second nozzle of the fourth group a4 include the second nozzle of the first group a1, the second nozzle of the second group a2, and the second nozzle of the third group a3.

S300, based on the printing parameters, acquiring second data corresponding to the compensation nozzle in a normal printing state based on the printing parameters which includes ink out data and ink holding data, determining an address of the ink holding data, and generating compensation data by writing the first data into the address of the ink holding data.

In some embodiments, the pass of the inkjet head may include a plurality of abnormal nozzles, and the method for compensating the abnormal nozzles are the same with each other. Taking one of the abnormal nozzles of one inkjet head in the shuttle scanning printing as an example, the method for compensating the abnormal nozzle is as follows.

Based on the position information of the abnormal nozzle, acquiring the first data corresponding to the abnormal nozzle. In the embodiment, the first data is marked as the first abnormal nozzle printing data.

Supposed that the first abnormal nozzle printing data is:

$$\mathrm{SrcData}_1[n]=\{S1,S2,S3,S4, \ldots ,Sn\}$$

wherein n is a number of data elements in $\mathrm{SrcData}_x$, and S indicates corresponding data information.

Acquiring the second data of the compensation nozzle in the normal printing state based on the position information of the compensation nozzle, including steps as follows. The data of the printing area includes P data blocks (P is an natural number greater than 0), and the P data blocks include a first data block, a second data block . . . , a (P−1)-th data block, and a P-th data block. Thus, a d-th data block is printed by a d-th group of nozzles, wherein d is a natural number greater than 0 and d is less than or equal to P. The second data corresponding to the compensation nozzle is extracted from the P data blocks of the compensation nozzle according to the position information of the compensation nozzle.

Based on the second data and the first abnormal nozzle printing data, the actual printing data of each compensation nozzle can be obtained by compensating the first abnormal nozzle printing data of an e-th abnormal nozzle of an i-th group of nozzle of the corresponding pass according to the following steps, wherein i is a natural number greater than 0 and i is less than or equal to P.

In step S1, determining whether the e-th compensation nozzle of the first group of nozzles is normal or not, if the e-th compensation nozzle is normal, extracting Data 1 of the second data corresponding to the e-th compensation nozzle from the first data block, performing a logical OR operation between the Data 1 of the second data and the first abnormal nozzle printing data to obtain the first actual printing data, and updating the first abnormal nozzle printing data to obtain a second abnormal nozzle printing data, judging whether a number of data of the second abnormal nozzle printing data is equal to 0 or not, if the number of data is equal to 0, ending the compensation, if the number of data blocks is not equal to 0 or the e-th compensation nozzle is abnormal, proceeding to the next step.

In Step S2, determining whether the e-th compensation nozzle of the second group of nozzles is normal or not, if the e-th compensation nozzle is normal, extracting Data 2 of the second data corresponding to the e-th compensation nozzle from the second data block, performing a logical OR operation between Data 2 of the second data and the second abnormal nozzle printing data to obtain the second actual printing data, and updating the second abnormal nozzle printing data to obtain a third abnormal nozzle printing data, determining whether a number of data of the third abnormal nozzle printing data is equal to 0 or not, if the number of data is equal to 0, ending the compensation, if the number of data blocks is not equal to 0 or the e-th compensation nozzle of the second group of nozzles is abnormal, proceeding to the next step.

In step S3, determining whether the e-th compensation nozzle of the third group of nozzles is normal or not, if the e-th compensation nozzle is normal, extracting Data 3 of the second data corresponding to the e-th compensation nozzle from the third data block, performing a logical OR operation between the Data 3 of the second data and the third abnormal nozzle printing data to obtain the third actual printing data, and updating the third abnormal nozzle printing data to obtain a fourth abnormal nozzle printing data, determining whether a number of data of the fourth abnormal nozzle printing data is equal to 0 or not, if the number of data is equal to 0, ending the compensation, if the number of data blocks is not equal to 0 or the e-th compensation nozzle of the third group of nozzles is abnormal, proceeding to the next step.

In Step Sp, determining whether the e-th compensation nozzle of the P-th group of nozzles is normal or not, if the e-th compensation nozzle is normal, extracting Data P of the second data corresponding to the e-th compensation nozzle from the P-th data block, performing a logical OR operation between the Data P of the second data and the second abnormal nozzle printing data to obtain the P-th actual printing data, ending the compensation since there are no more compensation nozzles.

Supposed that an m-th second data corresponding to the e-th compensation nozzle of the m-th group of nozzles is expressed as follows:

$$\mathrm{DstData}_m[n]=\{D1,D2,D3,D4,\ldots,Dn\}$$

wherein n is a number of data elements in $\mathrm{DstData}_m$, D indicates corresponding data information, and m is the group number where the compensation nozzle is.

In the embodiment, for a position K in $\mathrm{DstData}_m$, when $\mathrm{DstData}_m(k)=0$, it indicates that the compensation nozzle stopping jetting ink at the position K during printing and the data at the position K in $\mathrm{SrcData}_m$ can be compensated by the data at the position K in $\mathrm{DstData}_m$. In some embodiments, the compensation nozzle stopping jetting ink at the position K during printing when $\mathrm{DstData}_m(k)=5$ is also applicable, which indicates that the compensation nozzle stopping jetting ink at the position K during printing. In other embodiments, a value of $\mathrm{DstData}_m(k)$ can be any proper value.

Supposed that there is a new algorithm⊗:

$$\alpha\otimes\beta\equiv\begin{cases}\alpha,\ \beta=0\\ \beta,\ \beta\neq 0\end{cases}$$

wherein α and β are two numerical values, ⊗ indicates a kind of operation; when β is equal to 0, a result of the operation of α⊗β is α; when β is not equal to 0, the result of the operation of α⊗β is β.

The ⊗ operation is performed between the data in $\mathrm{SrcData}_x$ and $\mathrm{DstData}_m$ in turn, and assigning results of the operations to $\mathrm{DstData}_m$, that is:

$$\mathrm{DstData}_m(k)=\mathrm{SrcData}_1(k)\otimes\mathrm{DstData}_m(k)k=1,2,\ldots,n$$

wherein $\mathrm{DstData}_m$, is an m-th actual printing data corresponding to the e-th compensation nozzle of the m-th group of nozzles.

Supposed that there are n data elements in $\mathrm{SrcData}_1$ needed to be compensated, and there are n1 ink holding data elements in $\mathrm{DstData}_m$ which can be used for compensating the data in $\mathrm{SrcData}_1$, extracting the corresponding data elements from $\mathrm{SrcData}_1$ to obtain $\mathrm{SrcData}_2$:

$$\mathrm{SrcData}_2[n-n1]=\{D1,D2,D3,D4,\ldots,D(n-n1)\}.$$

If n−n1=0, it indicates that all the data elements in $\mathrm{SrcData}_1$ have been compensated, in this situation, if there is any unprocessed compensation nozzle, the actual printing data is stored as the second data; if there is not any unprocessed compensation nozzle, it indicates that the data of the abnormal nozzles can be just compensated.

If n−n1≠0, it indicates that not all the data elements in $\mathrm{SrcData}_1$ have been compensated; in this situation, if there is not any unprocessed compensation nozzle, the data in $\mathrm{SrcData}_2$ is not processed any more.

If there is any unprocessed compensation nozzle, extracting the second data $\mathrm{DstData}_{m+1}$ corresponding to the e-th compensation nozzle of an (m+1)-th group of nozzles, and performing the ⊗ operation between the data elements in $\mathrm{DstData}_{m+1}$ and $\mathrm{SrcDat}_2$, and assigning the result of the operation to $\mathrm{DstData}_{m+1'}$, that is:

$$\mathrm{DstData}_{m+1'}(k)=\mathrm{SrcData}_2(k)\otimes\mathrm{DstData}_{m+1}(k)k=1,2,\ldots,n$$

wherein $\mathrm{DstData}_{m+1}$ is an (m+1)-th actual printing data corresponding to the compensation nozzle of the (m+1)-th group of nozzles.

Supposed that there is n−n1 data elements in $\mathrm{ScrData}_2$ needed to be compensated, and there are $n_2$ ink holding data elements in $\mathrm{DstData}_{m+1}$ which can be used for compensating the data in $\mathrm{ScrData}_2$, deleting the data in $\mathrm{SrcData}_{x+1}$ corresponding to the $n_2$ ink holding data in $\mathrm{DstData}_{m+1}$ to obtain $\mathrm{ScrData}_3$.

$$\mathrm{SrcData}_3[n-n1-n2]=\{D1,D2,D3,D4,\ldots,D(n-n1-n2)\}.$$

Repeating the above judgment until the number of data elements in the abnormal nozzle printing data is equal to 0 or there is not any unprocessed compensation nozzle.

Figure 8:
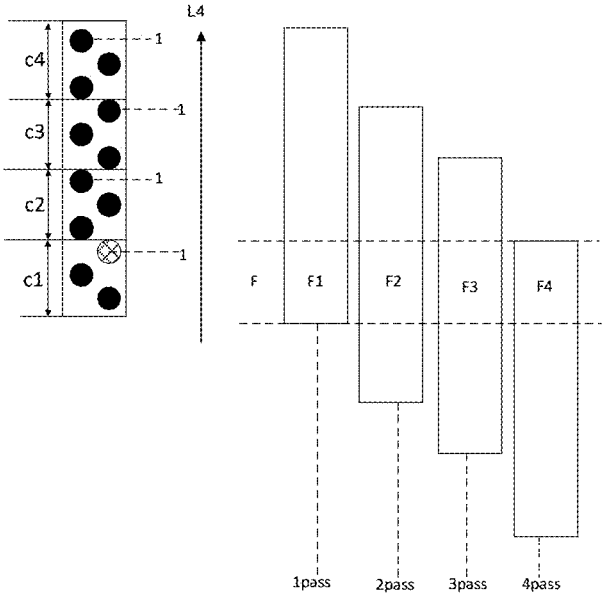
FIG. 8 is a first schematic view showing the compensation of the abnormal nozzle of the compensation method for nozzle abnormality of an inkjet printer in accordance with a best mode of the present invention.

Referring to FIG. 8, for a printing area F, the printing can be finished by 4 passes, and the paper feeding direction is L4 as shown in FIG. 8. Supposed that the first data block printed by Pass 1 is F1, the second data block printed by Pass 2 is F2, the third data block printed by Pass 3 is F3, the fourth data block printed by Pass 4 is F4, then the nozzles in one pass are evenly divided into four groups, namely a first group c1, a second group c2, a third group c3, and a fourth group c4. In an embodiment, if the abnormal nozzle corresponds to the third nozzle of the first group c1, then the compensation nozzles of the abnormal nozzle include the third nozzle of the second group c2, the third nozzle of the third group c3, and the third nozzle of the fourth group c4. The first data corresponding to the third nozzle is extracted from the first data block F1 as the first abnormal nozzle printing data $\mathrm{SrcData}_1$. The number of data sets in $\mathrm{SrcData}_1$ is 20. The third nozzle in the second data block F2 is marked as $DstData_2$, the third nozzle in the third data block F3 is marked as $DstData_3$, and the third nozzle in the fourth data block F4 is marked as $DstData_4$.

The ⊗ operation is performed between the data in $SrcData_1$ and $DstData_2$ to obtain the second actual printing data $DstData_2$ corresponding to the third nozzle of the second group of nozzles and the second abnormal nozzle printing data $ScrData_2$:

$$SrcData_1[20]=\{S1,S2,S3,S4,S5,S6,S7,S8,S9,S10,S11,S12,S13,S14,S15,S16,S17,S18,S19,S20\},$$

$$DstData_2[20]=\{0,1,2,0,3,2,3,0,1,2,0,0,1,3,2,0,3,0,2,1\}.$$

The ink holding data in $DstData_2$ capable of compensating $SrcData_1$ includes $DstData_2[1]=0$, $DstData_2[4]=0$, $DstData_2[8]=0$, $DstData_2[11]=0$ $DstData_2[12]=0$, $DstData_2[16]=0$, and $DstData_2[18]=0$.

Following operations are performed between each data elements in $SrcData_1$ and the corresponding data elements in $DstData_2$:

$$DstData_{2'}(k)=SrcData_1(k)\otimes DstData_2(k)k=1,2,\ldots,20.$$

Through the above operations, the second actual compensation printing data $DstData_{2'}$ is obtained:

$$DstData_{2'}[20]=\{S,1,2,S4,3,2,3,S8,1,2,S11,S12,1,3,2,S16,3,S18,2,1\}.$$

And the second abnormal nozzle printing data is:

$$SrcData_2[13]=\{S2,S3,S5,S6,S7,S9,S10,S13,S14,S15,S17,S19,S20\}.$$

If the number of the data in $SrcData_2$ is not equal to 0, the compensation is continued.

The ⊗ operation is performed between the data elements in $SrcData_2$ and $DstData_3$, to obtain the third actual printing data $DstData_3$ corresponding to the third nozzle of the third group of nozzles and the third abnormal nozzle printing data $ScrData_3$:

$$DstData_3[13]=\{0,2,3,0,1,0,2,2,1,3,2,0,3\}.$$

The following operation is performed to each data element in $SrcData_2$ and the corresponding data element in $DstData_3$.

$$DstData_{3'}(k)=SrcData_2(k)\otimes DstData_3(k)k=1,2,\ldots,13.$$

Through the above operation, the third actual printing data $DstData_3$ of the third nozzle of the third group of nozzles is obtained:

$$DstData_{3'}[13]=\{S2,2,3,S6,1,S9,2,2,1,3,2,S19,3\}.$$

The third abnormal nozzle printing data is:

$$SrcData_3[9]=\{S3,S5,S7,S10,S13,S14,S15,S17,S20\}.$$

If the number of data elements in $SrcData_3$ is not equal to 0, the compensation is continued.

The ⊗ operation is performed between the data in $SrcData_3$ and $DstData_4$, to obtain the fourth actual printing data $DstData_{4'}$ corresponding to the third nozzle of the fourth group of nozzles and the fourth abnormal nozzle printing data $ScrData_4$:

$$DstData_4[9]=\{2,0,0,0,0,2,0,0,0\}.$$

The ink holding data in $DstData_4$ capable of compensating $SrcData_2$ includes $DstData_4[2]=0$, $DstData_4[3]=0$, $DstData_4[4]=0$, $DstData_4[5]=0$ $DstData_4[7]=0$, $DstData_4[8]=0$, and $DstData_4[9]=0$.

The following operation is performed to each data element in $SrcData_3$ and the corresponding data element in $DstData_4$:

$$DstData_{3'}(k)=SrcData_2(k)\otimes DstData_3(k)k=1,2,\ldots,9.$$

The fourth actual printing data $DstData_4'$ of the third nozzle of the fourth group of nozzles is obtained by the following operations:

$$DstData_{4'}[9]=\{2,S5,S7,S10,S13,2,S15,S17,S20\}.$$

The fourth abnormal nozzle printing data is:

$$SrcData_4[2]=\{S3,S14\}.$$

The fourth abnormal nozzle printing data still has two data elements to be compensated, however, since all the compensation holes are used, the compensation is over.

When the second data block F2 is being printed, the third nozzle of the second group c2 performs the printing according to the data in $DstData_{2'}$; when the third data block is being printed, the third nozzle of the third group c3 performs the printing according to the data in $DstData_3$, and when the fourth data block is being printed, the third nozzle of the fourth group c4 performs the printing according to the data in $DstData_4$. Thus, a part of data of the third nozzle of the first group c1 is compensated by the third nozzle of the second group, the third group, and the fourth group, thus, a problem that a printed image has broken lines or a problem that a printing effect is poor due to the abnormality of the nozzle can be avoided.

When there are multiple abnormal nozzles, the compensation for the abnormal nozzles includes following steps.

In step S310, according to the printing parameters and the covering times corresponding to the same area on the printing medium, acquiring the current paper feeding distance covering on the printing medium and a compensation range of the first abnormal nozzle, building a second mapping relationship between the position of the first abnormal nozzle, the printing position of the first abnormal nozzle on the printing medium, and the first data corresponding to the first abnormal nozzle.

In step S320, if the printing position of the first abnormal nozzle on the printing medium is in the current printing range of the inkjet head, storing the second mapping relationship and backing up the first data.

In step S330, searching the stored second mapping relationships to determine whether, in the printing range covering the current printing medium, there is any abnormal nozzle except the first abnormal nozzle with its printing position in the printing range.

In step S340, if there is, marking the corresponding abnormal nozzle as the second abnormal nozzle, and acquiring the printing position information of the second abnormal nozzle on the printing medium according to the second mapping relationship, calculating the compensation nozzle capable of compensating the second abnormal nozzle in the printing range covering the current printing medium, and generating the compensation data by writing the backup of the printing data of the second abnormal nozzle in the second mapping relationship into the address of the ink holding data of the compensation nozzle.

Meanwhile, if the printing position of the first abnormal nozzle on the printing medium is not within the current printing range of the inkjet head, the second mapping relationship is not stored, thus, the mapping relationship of the first abnormal nozzle cannot be searched and thus the first abnormal nozzle cannot be compensated by the current printing.

The above second mapping relationship is built through the following method.

Figure 9:
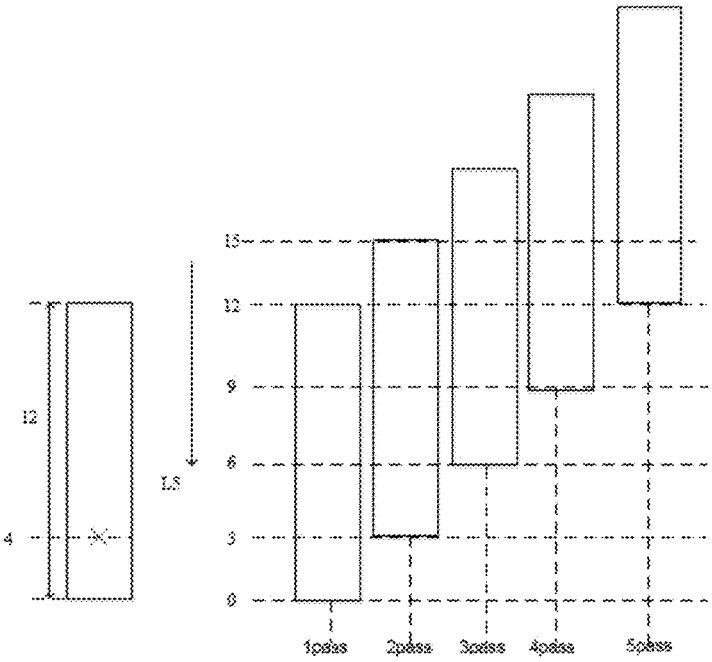
FIG. 9 is a second schematic view showing the compensation of the abnormal nozzle of the compensation method for nozzle abnormality of an inkjet printer in accordance with a best mode of the present invention.

Defining a parameter P as the printing times of the first shuttle scanning printing, wherein P is an integer equal to or greater than 2, that is, each block of image is formed by P times of printing (that is, P passes). defining X as the current printing index, which indicates the current printing times counted from the beginning of the printing. Calculation is performed to determine whether all the abnormal nozzles are in the printing range of the P times of printing including the current printing. Taking one of the abnormal nozzles as the 1st nozzle, the beginning printing position of an X-th printing is marked as $S_x$ which is equal to the relative displacement between the printing medium and the inkjet head in the previous X times of printing, a newly-increased covering distance on the printing medium of the X-th printing is marked as $h_x$, a height of the inkjet is marked as H, then a newly-increased covering range of the X-th printing is $[S_x+H-h_x, S_x+H]$. taking the distance between the 1st nozzles as W in the direction, along which the said nozzle has a relative increasing displacement against the printing medium, initial positions of an (x+0)-th, an (X+1)-th, . . . an (X+P−1)-th printing being respectively $S_x$, $S_{x+1}$, . . . , $S_{X+P-1}$, and the newly-increased covering range of each printing being $[S_x+H-h_x, S_x+H]$, and the printing positions of the 1st nozzle being respectively $S_x+W$, $S_{x+1}+W$, . . . , $S_{X+P-1}+W$. If the printing position of the 1st nozzle on the printing medium in not within the newly-increased covering range, the mapping relationship which is the first mapping relationship in the embodiment will not be stored; if the printing position of the 1st nozzle on the printing medium is within the newly-increased covering range and is different from the stored first mapping relationship, storing the first mapping relationship, and extracting the first data of the 1st nozzle. The first mapping relationship includes the corresponding printing index and the printing position of the 1st nozzle. Referring to FIG. 9, in an embodiment, the height of the inkjet head is 12 (the numerical values hereinafter are used for facilitating the illustration of the technical solution of the present invention, and the numerical values are set under the same standard; the person skilled in the art can understand the technical solution according to the embodiments of the present invention; in this embodiment, the height of the inkjet head being 12 indicates 12 nozzles), the printing times of the first shuttle scanning printing is 4 (namely 4 passes), that is, each block of initial image is formed by 4 times of component printing and the covering range of each time of component printing is 3 (which corresponds to one fourth of the height of the inkjet head, namely the covering distance of the inkjet head on the same area in each time of printing). If the current printing is the first pass printing and the initial position of the first pass is 0, the newly-increased covering range of the first pass is [9, 12], the distance between the 1st nozzle and the first nozzle in a direction along which the relative displacement between the inkjet head and the printing medium is increased is 4 (that is, the fourth nozzle counted from the initial position is abnormal). If the first nozzle is abnormal and the inkjet head only includes one nozzle, the moving distances of the printing medium after the first pass, the second pass, and the third pass are all 3, the printing position of the 1st nozzle on the printing medium during the first pass printing is 4, which is not within the newly-increased covering range [9, 12], thus, the first mapping relationship is not stored; the printing position of the 1st nozzle on the printing medium during the second pass printing is 7, which is not within the newly-increased covering range [9, 12], thus, the first mapping relationship is not stored; the printing position of the 1st nozzle on the printing medium during the first pass printing is 10, which is within the newly-increased covering range [9, 12], thus, the first mapping relationship which includes the printing index 3 and the printing position 10 of the 1st nozzle is stored, and the backup of the printing data of the 1st nozzle is extracted; and, the printing position of the 1st nozzle on the printing medium during the second pass printing is 13, which is not within the newly-increased covering range [9, 12], thus, the first mapping relationship is not stored.

Generating the compensation data by writing the first data into the address of the ink holding data of the second data according to the printing parameters and the first mapping relationship includes steps as follows.

When the current printing is the X-th printing, individually searching the stored first mapping relationships; marking the abnormal nozzle corresponding to one of the mapping relationships as a 2nd nozzle, extracting a printing position of the 2nd nozzle from the first mapping relationship; if the printing position of the 2nd nozzle is less than the initial position of the current printing, the first mapping relationship is considered as outdated and is deleted from the storage; if the printing position of the 2nd nozzle is greater than the initial position of the current printing, the mapping relationship is valid; if $Z_x$, which is obtained by subtracting the initial position of the current printing from the printing position of the 2nd nozzle, is less than H, the first printing data corresponding to the 2nd nozzle can be compensated, that is, the missed printing line is located in the range of the inkjet head. If the nozzle at the position $Z_x$ is a normal one, then the nozzle at the position $Z_x$ is the compensation nozzle of the 2nd nozzle which is marked as a 3rd nozzle. The compensation data of the 3rd nozzle can be obtained by writing the first data of the 2nd nozzle into the address of the ink holding data of the second data corresponding to the 3rd nozzle. The printing data of the 3rd nozzle includes the original ink out data and the written compensation data. The compensated data corresponding to the 2nd nozzle which has been written into the 3rd nozzle stored in the storage is erased. For the 2nd nozzle, during the process in which the relative displacement between the printing medium and the inkjet head is increased, the third data, the fourth data, . . . an N-th data of the 2nd nozzle is continuously obtained until the writing of the data of the 2nd nozzle is finished or the first mapping relationship of corresponding to the 2nd nozzle is outdated. The third data is the remaining to-be-compensated data of the second data after compensation, the fourth data is the remaining to-be-compensated data of the third data after compensation, and the N-th data of the remaining to-be-compensated data of an (N−1)-th data after compensation, wherein $4 \leq N \leq M$ and N is an integer.

Referring to FIG. 9, according to the first mapping relationship, the printing position of the first mapping relationship corresponding to the printing medium is 10.

When the current printing is the first pass printing, the initial printing position is 0 (under the same standard), the value obtained by subtracting the initial position of the current printing from the printing position corresponding to the first mapping relationship is 10, which is less than the height 10 of the inkjet head. At this time, since the nozzle which is distanced from the first nozzle at 10 in the direction along which the relative displacement between the inkjet head and the printing medium is increased is a normal one, the first compensation nozzle of the first mapping relationship is obtained. The compensation data of the first compensation nozzle is obtained by writing the printing data of the first mapping relationship into the address of the ink holding data of the first compensation nozzle. The part of the printing data of the first mapping relationship which has been compensated is erased to obtain the first post-compensated data of the first mapping relationship.

When the current printing is the second pass printing, the initial printing position is 3, the value obtained by subtracting the initial position of the current printing from the printing position corresponding to the first mapping relationship is 7, which is less than the height 12 of the inkjet head. At this time, since the nozzle which is distanced from the first nozzle at 7 in the direction along which the relative displacement between the inkjet head and the printing medium is increased is a normal one, the second compensation nozzle of the first mapping relationship is obtained. The compensation data of the second compensation nozzle is obtained by writing the first post-compensated data into the address of the ink holding data of the second compensation nozzle. The part of the first post-compensated data which has been compensated in the printing is erased to obtain the second post-compensated data of the first mapping relationship.

When the current printing is the third pass printing, the initial printing position is 6, the value obtained by subtracting the initial position of the current printing from the printing position corresponding to the first mapping relationship is 4, which is less than the height 12 of the inkjet head. At this time, since the nozzle which is distanced from the first nozzle at 4 in the direction along which the relative displacement between the inkjet head and the printing medium is increased is an abnormal one, thus, the compensation for first mapping relationship cannot be performed.

When the current printing is the fourth pass printing, the initial printing position is 9, the value obtained by subtracting the initial position of the current printing from the printing position corresponding to the first mapping relationship is 1, which is less than the height 12 of the inkjet head. At this time, since the nozzle which is distanced from the first nozzle at 1 in the direction along which the relative displacement between the inkjet head and the printing medium is increased is a normal one, the third compensation nozzle of the first mapping relationship is obtained. The compensation data of the third compensation nozzle is obtained by writing the second post-compensated data into the address of the ink holding data of the third compensation nozzle. The part of the second post-compensated data which has been compensated in the printing is erased to obtain the third post-compensated data of the first mapping relationship.

When the current printing is the fifth pass printing, the initial printing position is 12, and the printing position 10 of the first abnormal nozzle is less than the initial printing position 12 of the current printing, thus, the first mapping relationship cannot be compensated from the fifth printing and the compensation is over.

Figure 10:
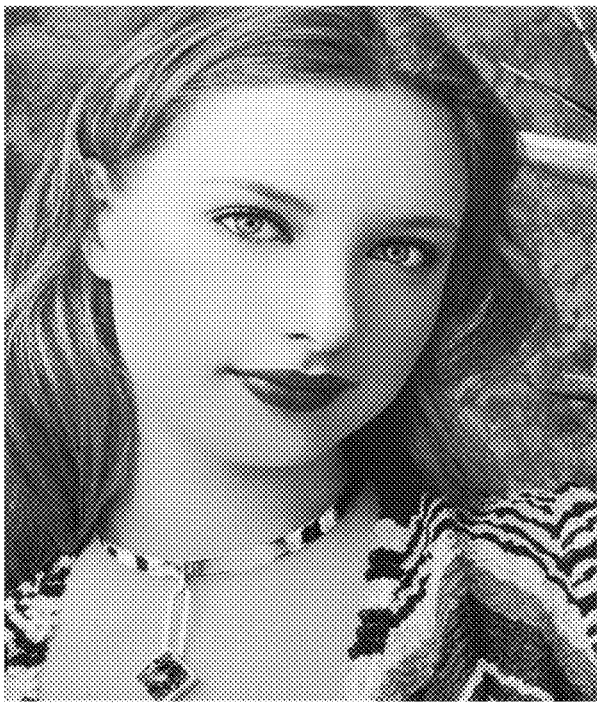
FIG. 10 is a schematic view showing the effect of the compensation method for nozzle abnormality of an inkjet printer in accordance with a best mode of the present invention.

The method for compensating abnormality of the nozzle of the inkjet printer is given in detail as above. FIG. 10 shows the effect of the above method. From FIG. 10, with the compensation for the abnormal nozzle provided in the above method, the printing effect of the inkjet printer is almost the same as that of inkjet printer in the situation that all the nozzles are normal. Thus, the broken lines or blank space can be avoided without replacing the inkjet head due to the abnormal nozzles, greatly saving the cost of the inkjet printing apparatus.

Embodiments of the Present Invention

Embodiment 1

Figure 11:
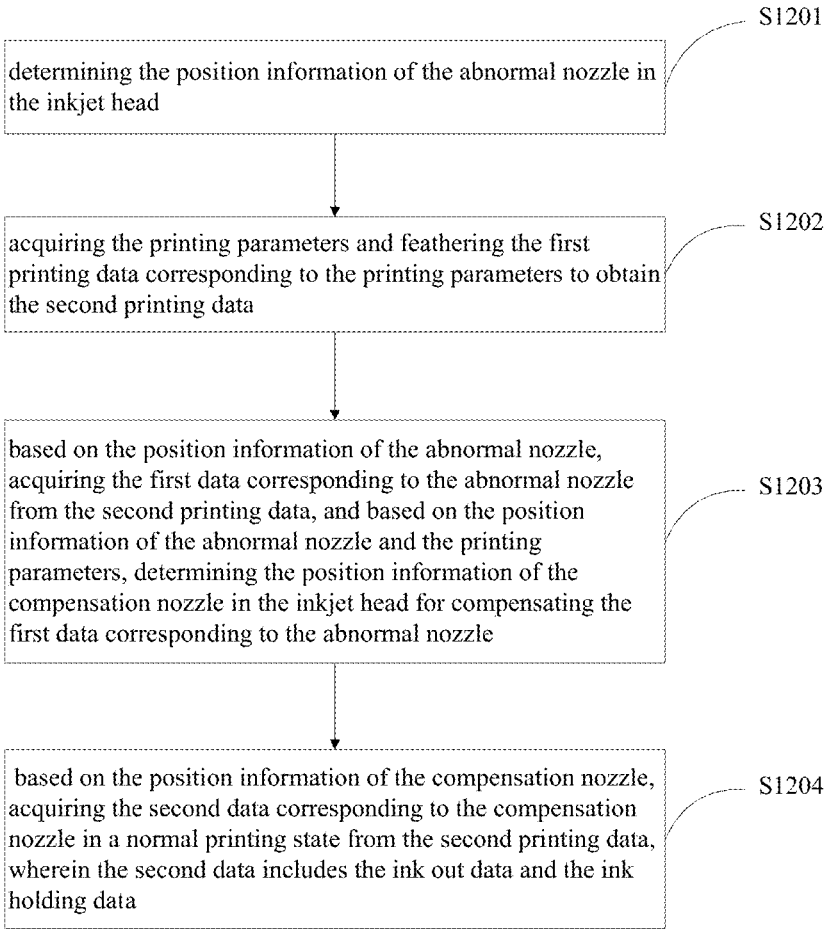
FIG. 11 is a flow chart of a compensation method for nozzle abnormality of an inkjet printer in accordance with a first embodiment of the present invention.

Referring to FIG. 11, in this embodiment, feathering process is added to increase chance for compensating the abnormal nozzle and improve quality of the printed image, including steps as follows.

In step S1201, determining the position information of the abnormal nozzle in the inkjet head.

In step S1202, acquiring the printing parameters and feathering the first printing data corresponding to the printing parameters to obtain the second printing data.

In step S1203, based on the position information of the abnormal nozzle, acquiring the first data corresponding to the abnormal nozzle from the second printing data, and based on the position information of the abnormal nozzle and the printing parameters, determining the position information of the compensation nozzle in the inkjet head for compensating the first data corresponding to the abnormal nozzle.

In step S1204, based on the position information of the compensation nozzle, acquiring the second data corresponding to the compensation nozzle in a normal printing state from the second printing data, wherein the second data includes the ink out data and the ink holding data.

The second printing data includes the first data and the second data.

In the embodiment, the printing parameters include a feathering amplitude, and feathering the first printing data corresponding to the printing parameters to obtain the second printing data includes following steps.

Obtaining the printing times of the second shuttle scanning printing based on the printing times of the first shuttle scanning printing and the feathering amplitude, wherein the printing times of the second shuttle scanning printing is greater than that of the first shuttle scanning printing.

Feathering the to-be-printed first printing data to obtain the second printing data based on the printing times of the second shuttle scanning printing, wherein the number of the ink holding data elements in the second printing data is greater than that of the ink holding data elements in the first printing data.

In the embodiment, the second printing data is obtained by feathering the first printing data corresponding to the printing parameters, and the number of the ink holding data elements in the feathered second printing data is greater than the number of the ink holding data elements in the first printing data, thus, the chance for compensating the abnormal nozzle is improved. The method for compensating the abnormal nozzle is the same as that provided in the best mode, the difference there between lies in that the data of all the nozzles including the first data of the abnormal nozzle and the second data of the compensation nozzle are obtained from the feathered second printing data, and the position information of the compensation nozzle is determined through the printing times of the second shuttle scanning printing.

The paper feeding distance (the relative displacement between the printing medium and the inkjet head) after the second printing data is feathered can be obtained through the following formula:

$$q = \frac{x5}{y1} - \frac{r}{y1}$$

wherein x5 is a number of the nozzles in one pass, r is a number of feathering points obtained through the feathering amplitude, y1 is the printing times of the first shuttle scanning printing, q is the paper feeding distance.

The printing times of the second shuttle scanning printing can be obtained through the following formula:

$$y2 = \left\lceil \frac{x3}{q} \right\rceil$$

wherein y2 is the printing times of the second shuttle scanning printing, "⌈ ⌉" is a ceiling symbol.

The feathering process of the first printing data includes: based on the number of the feathering points, dividing a first printing data matrix corresponding to the first printing data of the corresponding pass in a to-be-printed area into 3 parts, which are respectively a first printing data matrix, a second printing data matrix, and a third printing data matrix, wherein a height of the first printing data matrix is equal to that of the third printing data matrix, the first, second, and third printing data matrixes have the same width, and the sum of the heights of the first, the second, and the third printing data matrixes is equal to the number of the nozzles in the corresponding pass.

A feathering template is preset. The feathering template is selected according to the number of the feathering points. A feathering data matrix corresponding to the feathering template is extracted, and a complementary feathering data matrix is obtained by subtracting the feathering data matrix from an unit matrix, wherein a height of the unit matrix is equal to that of the feathering data matrix, and a width of the unit matrix is equal to that of the feathering data matrix. A logical AND operation is performed between the feathering data matrix and the first printing data matrix to obtain a first feathering data matrix, a logical AND operation is performed between the complementary feathering data matrix and the third printing data matrix to obtain a second feathering data matrix, the first feathering data matrix, the second printing data matrix, and the second feathering data matrix are combined to form the second printing data matrix of the corresponding pass of the corresponding to-be-printed area, wherein the number of the ink holding data elements in the second printing data is greater than that of the ink holding data elements in the first printing data. Thus, the chance for compensating the first data corresponding to the abnormal nozzle is improved. In the embodiment, the height of the feathering data matrix is equal to that of the first printing data matrix, and the width of the feathering data matrix is equal to that of the first printing data matrix. In other embodiments, the width of the feathering data matrix can be less than that of the first printing data matrix, and the width of the feathering data matrix can be equal to that of the first printing data matrix, which is not limited hereinafter.

In the embodiment, the first feathering data matrix is obtained by performing a logical AND operation between the feathering data matrix and the first printing data matrix. The first feathering data matrix can be:

$$M1=M.\times T$$

wherein T is the feathering data matrix, M is the first printing data matrix, .× is the dot product between the two matrixes, and M1 is the first feathering data matrix.

The complementary feathering data matrix can be obtained through the following formula:

$$T'=E-T$$

wherein E is the unit matrix with all elements therein being equal to 1, and T' is the complementary feathering data matrix.

The second feathering data matrix is obtained by performing a logical AND operation between the complementary data matrix and the third printing data matrix:

$$M2=M'.\times T'$$

wherein M' is the third printing data matrix, .× is the dot product between matrixes, and M2 is the second feathering data matrix.

Figure 12:
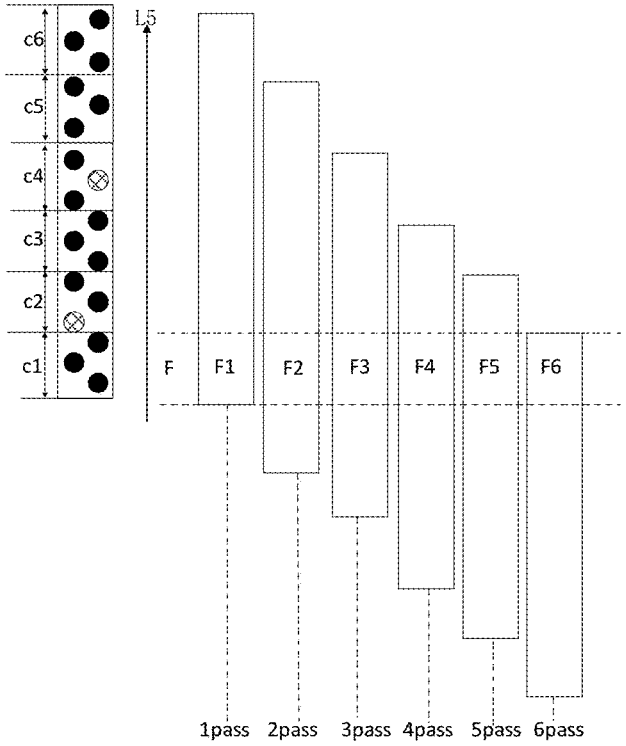
FIG. 12 is a schematic view showing the compensation of the abnormal nozzle of the compensation method for nozzle abnormality of an inkjet printer in accordance with the first embodiment of the present invention.

As shown in FIG. 12, for the printing area F, the printing can be finished by 4 passes and by 6 passes after being feathered, and the paper feeding direction is L5 as shown in FIG. 12. Supposed that the first data block printed by the first pass is F1, the second data block printed by the second pass is F2, the third data block printed by the third pass is F3, the fourth data block printed by the fourth pass is F4, the fifth data block printed by the third pass is F5, the sixth data block printed by the fourth pass is F6, then the nozzles in one pass are evenly divided into six groups, namely a first group c1, a second group c2, a third group c3, a fourth group c4, a fifth group c5, and a sixth group c6. In an embodiment, if the abnormal nozzles are the first nozzle in the second group c2 and the second nozzle in the fourth group c4, then the compensation nozzles of the first nozzle of the second group c2 include the first nozzles of the second group c1, the third group c3, the fourth group c4, the fifth group c5, and the sixth group c6, and the compensation nozzles of the second nozzle of the second group c2 include the second nozzles in the first group c1, the second group c2, the third group c3, the fifth group c5, and the sixth group c6.

The data of the first nozzle of the second group c2 is compensated as follows. The first data being marked as $SrcData_1$ corresponding to the first nozzle is extracted from the second data block F2, the second data corresponding to the first nozzle in the first data block F1 is marked as $DstData_1$, the second data corresponding to the first nozzle in the third data block F3 is marked as $DstData_3$, the second data corresponding to the first nozzle in the fourth data block F4 is marked as $DstData_4$, the second data corresponding to the first nozzle in the fifth data block F5 is marked as $DstData_5$, and second data corresponding to the first nozzle in the sixth data block F6 is marked as $DstData_6$.

The ⊗ operation is performed between the data in $SrcData_1$ and the data in $DstData_1$ to obtain the first actual printing data $DstData_{1'}$ of the first nozzle of the first group c1 and the second abnormal nozzle printing data $SrcData_2$:

$$SrcData_1[20]=\{S1,S2,S3,S4,S5,S6,S7,S8,S9,S10,S11,S12,S13,S14,S15,S16,S17,S18,S19,S20\},$$

$$DstData_1[20]=\{0,1,2,0,3,2,3,0,1,2,0,0,1,3,2,0,3,0,2,1\}.$$

The ink holding data in $DstData_1$ capable of compensating $SrcData_1$ includes $DstData_1[1]=0$, $DstData_1[4]=0$, $DstData_1[8]=0$, $DstData_1[11]=0$ $DstData_1[12]=0$, $DstData_1[16]=0$, and $DstData_1[18]=0$.

The following operation is performed between each data element in $SrcData_1$ and the corresponding data element in $DstData_1$:

$$DstData_{1'}(k)=SrcData_1(k)\otimes DstData_1(k)k=1,2,\ldots,20.$$

Through the above operation, the first actual printing data $DstData_{1'}$ of the first nozzle of the first group c1 and the second abnormal nozzle printing data are obtained:

$$DstData_{1'}[20]=\{S1,1,2,S4,3,2,3,S8,1,2,S11,S12,1,3,2,S16,3,S18,2,1\}.$$

The second abnormal nozzle printing data is:

$$SrcData_2[13]=\{S2,S3,S5,S6,S7,S9,S10,S13,S14,S15,S17,S19,S20\}.$$

Since the number of the data elements in $SrcData_2$ is not equal to 0, the compensation is continued.

The ⊗ operation is performed between the data in $SrcData_2$ and the data in $DstData_3$ to obtain the third actual printing data $DstData_{3'}$ of the first nozzle of the third group c3 and the third abnormal nozzle printing data $SrcData_3$:

$$DstData_3[13]=\{0,2,3,0,1,0,2,2,1,3,2,0,3\}.$$

The ink holding data in $DstData_3$ capable of compensating $SrcData_2$ includes $DstData_3[1]=0$, $DstData_3[4]=0$, $DstData_3[6]=0$, and $DstData_3[12]=0$.

The following operation is performed between each data element in $SrcData_2$ and the corresponding data element in $DstData_3$:

$$DstData_{3'}(k)=SrcData_2(k)\otimes DstData_3(k)k=1,2,\ldots,13.$$

Through the above operation, the third actual printing data $DstData_{3'}$ of the first nozzle of the third group c3 and the third abnormal nozzle printing data are obtained:

$$DstData_{3'}[13]=\{S2,2,3,S6,1,S9,2,2,1,3,2,S19,3\}.$$

The third abnormal nozzle printing data is:

$$SrcData_3[9]=\{S3,S5,S7,S10,S13,S14,S15,S17,S20\}.$$

Since the number of the data elements in $SrcData_3$ is not equal to 0, the compensation is continued.

The ⊗ operation is performed between the data in $SrcData_3$ and the data in $DstData_4$ to obtain the fourth actual printing data $DstData_4$, of the first nozzle of the fourth group c4 and the fourth abnormal nozzle printing data $SrcData_4$:

$$DstData_4[9]=\{2,0,0,0,0,2,0,0,0\}.$$

The ink holding data in DstData4 capable of compensating SrcData2 includes $DstData_4[2]=0$, $DstData_4[3]=0$, $DstData_4[4]=0$, $DstData_4[5]=0$ $DstData_4[7]=0$, $DstData_4[8]=0$, $DstData_4[9]=0$.

The following operation is performed between each data element in $SrcData_3$ and the corresponding data element in $DstData_4$:

$$DstData_{4'}(k)=SrcData_5(k)\otimes DstData_4(k)k=1,2,\ldots,9.$$

Through the above operation, the fourth actual printing data $DstData_4'$ of the first nozzle of the fourth group c4 and the fourth abnormal nozzle printing data are obtained:

$$DstData_{4'}[9]=\{2,S5,S7,S10,S13,2,S15,S17,S20\}.$$

The fourth abnormal nozzle printing data is:

$$SrcData_4[2]=\{S3,S14\}.$$

The ⊗ operation is performed between the data in $SrcData_3$ and the data in $DstData_5$ to obtain the fifth actual printing data $DstData_{5'}$ of the first nozzle of the fifth group c5 and the fifth abnormal nozzle printing data $SrcData_5$:

$$DstData_5[9]=\{0,0\}.$$

The ink holding data in $DstData_5$ capable of compensating $SrcData_2$ includes $DstData_5[3]=0$, and $DstData_5[14]=0$.

The following operation is performed between each data element in $SrcData_4$ and the corresponding data element in $DstData_5$:

$$DstData_{5'}(k)=SrcData_4(k)\otimes DstData_5(k)k=1,2.$$

Through the above operation, the fifth actual printing data $DstData_5$ and the fifth abnormal nozzle printing data are obtained:

$$DstData_{5'}[9]=\{S3,S14\}.$$

The fifth abnormal nozzle printing data is:

$$SrcData_5[0]=\{\ \}.$$

Since the number of the data elements in the fifth abnormal nozzle printing data is equal to 0, the data of the first nozzle of the second group c2 is all compensated, and the compensation is finished.

The first data block F1 is printed by the first nozzle in the first group c1 with the data in $DstData_{1'}$, the third data block F3 is printed by the first nozzle of the third group c3 with the data in $DstData_3'$, the fourth data block F4 is printed by the first nozzle of the fourth group c4 with the data in $DstData_4'$, the fifth data block F5 is printed by the first nozzle of the fourth group c4 with the data in $DstData_5$, and the sixth data block F6 is printed by the first nozzle of the sixth group c6 with the data in $DstData_{5'}$. Thus, the part of data of the third nozzle of the second group c2 is compensated by the first nozzles of the first group c1, the third group c3, the fourth group c4, and the fifth group c5. The method for compensating the second nozzle of the fourth group c4 is the same as that for compensating the first nozzle of the second group c2, which is not given in detail hereinafter anymore. Other parts of the embodiment 1 are the same as those of the best mode, and detail illustration for these parts can be found in the best mode.

Embodiment 2

Figure 13:
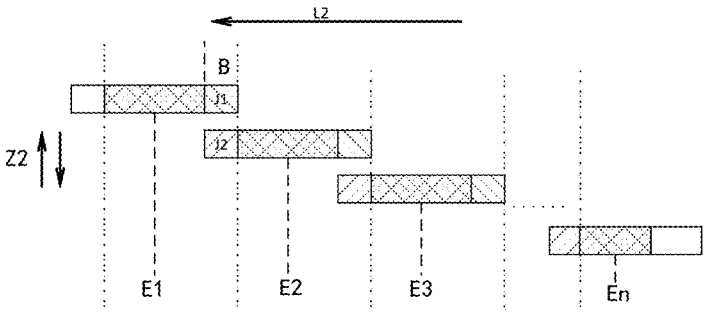
FIG. 13 is a schematic view showing an arrangement of inkjet heads of a compensation method for nozzle abnormality of an inkjet printer in accordance with a second embodiment of the present invention.

Referring to FIG. 13, compared with the embodiment 1, the scanning printing is this embodiment is one-time, that is, the printing times of the first shuttle scanning printing is 1. The printing times of the first shuttle scanning printing indicates a covering number of the unit area of the printing medium. The printing parameters further include a second feathering amplitude; after being feathered, an overlapping area is formed between two adjacent printings, and the first printing data is the printing data corresponding to the overlapping area. As shown in FIG. 13, an area B of the to-be-printed image is formed by two times of printing, and a moving direction of the printing medium is L2 as shown in FIG. 13, a moving direction of the inkjet head is Z2 as shown in FIG. 13. In the first moving, the inkjet head moves for E1, the area B is printed by a J1 part of the inkjet head, the printing medium moves for a distance less than the nozzle number of the inkjet head. In the second moving, the inkjet head moves for E2, and the area B is printed again by a part J2 of the inkjet head, thus, the printing of the area B is finished. The other areas are printed by the same way as the area B.

Figure 14:
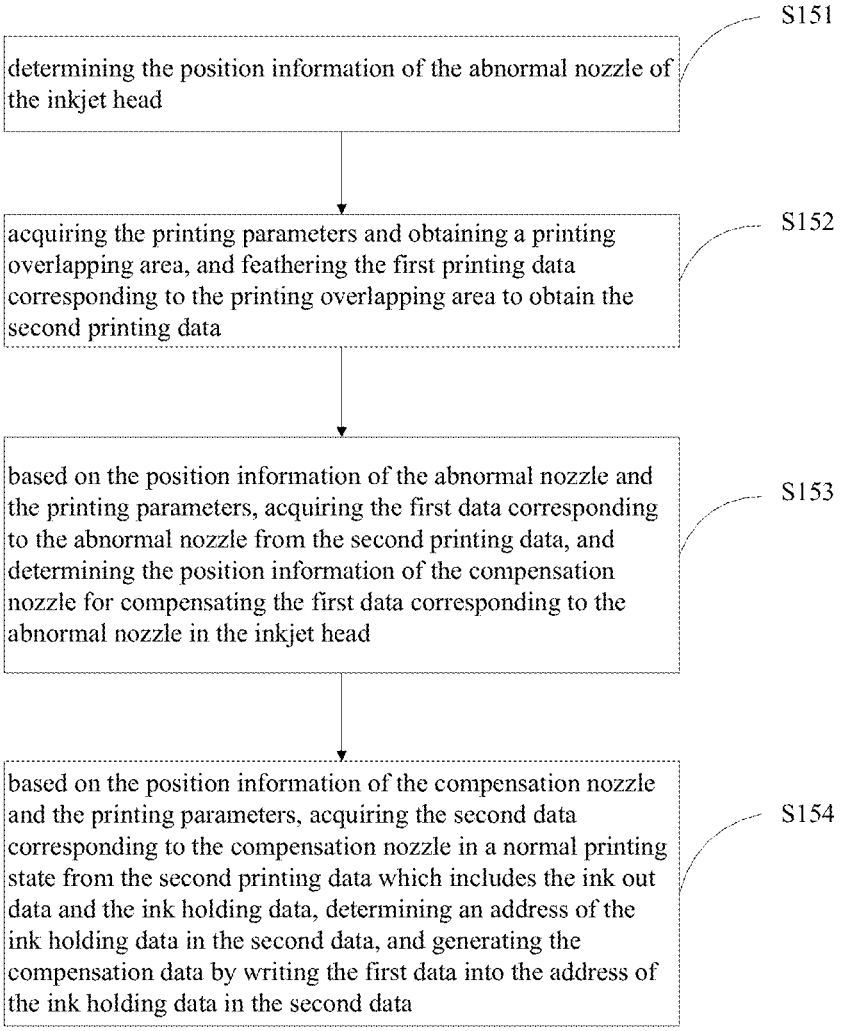
FIG. 14 is a flow chart of a compensation method for nozzle abnormality of an inkjet printer in accordance with the second embodiment of the present invention.

Referring to FIG. 14, the method of the embodiment includes following steps.

In step S151, determining the position information of the abnormal nozzle of the inkjet head.

In step S152, acquiring the printing parameters and obtaining a printing overlapping area, and feathering the first printing data corresponding to the printing overlapping area to obtain the second printing data.

In step S153, based on the position information of the abnormal nozzle and the printing parameters, acquiring the first data corresponding to the abnormal nozzle from the second printing data, and determining the position information of the compensation nozzle for compensating the first data corresponding to the abnormal nozzle in the inkjet head.

In step S154, based on the position information of the compensation nozzle and the printing parameters, acquiring the second data corresponding to the compensation nozzle in a normal printing state from the second printing data which includes the ink out data and the ink holding data, determining an address of the ink holding data in the second data, and generating the compensation data by writing the first data into the address of the ink holding data in the second data.

In an embodiment, the printing overlapping area is determined by the printing parameters, and the first printing data corresponding to the printing overlapping area is feathered to obtain the second printing data. The feathering amplitude is set such that the number of feathering points and the printing overlapping area are obtained through the feathering amplitude. A number of overlapping nozzles corresponding to the printing overlapping area is equal to that of the number of the feathering points. The relative displacement between the printing medium and the inkjet head, which is marked as a number of paper feeding points, is obtained by the number of feathering points. The position information of the compensation nozzle for compensating the printing data corresponding to the abnormal nozzle is determined by the number of paper feeding points, and the compensation nozzle and the abnormal nozzle are in the same pass.

The number of paper feeding points is obtained through the following formula:

$$x2=x1-r$$

wherein x1 is the number of nozzles in the corresponding pass, r is the number of feathering points, x2 is the number of the paper feeding points, and x1, r, x2 are all integers greater than 0.

The nozzles are numbered in the corresponding pass along the paper feeding direction, and a serial number of the abnormal nozzle is determined according to the position information of the abnormal nozzle. When the serial number the abnormal nozzle is greater than the number of feathering points but is less than the number of the paper feeding points, the first data corresponding to the abnormal nozzle cannot be compensated since there are no compensation nozzles.

When the serial number of the abnormal nozzle is less than or equal to the number of feathering points, a serial number of the compensation nozzle for compensating the printing data corresponding to the abnormal nozzle is obtained by the following formula:

$$Y=T+x2$$

wherein Y is the serial number of the compensation nozzle, and T is the serial number of the abnormal nozzle.

When the serial number of the abnormal nozzle is greater than or equal to the number of the paper feeding points, the serial number of the compensation nozzle for compensating the printing data corresponding to the abnormal nozzle is obtained by the following formula:

$$Y=T-x2$$

wherein Y is the serial number of the compensating nozzle, and T is the serial number of the abnormal nozzle.

Supposed that the printing data corresponding to the pass after an m-th paper feeding is the original printing data matrix. Based on the number of feathering points, the original printing matrix is divided into a first printing data matrix, a second printing data matrix, and a third printing data matrix. A sum of heights of the first printing data matrix, the second printing data matrix, and the third printing data matrix is equal to the number of nozzles in the corresponding pass, the height of the first printing data matrix is equal to that of the third printing data matrix, and the height of the first printing data matrix is equal to the number of the feathering points. The first and third printing data matrixes are located in the printing overlapping area, and the printing data corresponding to the printing overlapping area is the first printing data. The original printing data corresponding to the original printing data matrix includes the first printing data. Since the original printing data matrix includes the first printing data and the height of the first printing data is equal to the number of feathering points, the greater the feathering amplitude is, the greater the overlapping area is. With a larger overlapping are, there are more abnormal nozzles in the overlapping area, thus, the chance for compensating the abnormal nozzle is improved. The data corresponding to the matrix formed by combining the first printing data matrix and the third printing data matrix is the first printing data.

For example, in the embodiment, the number of the nozzles in the corresponding pass is 12, when the number of the feathering points is 2dot and the number of paper feeding points is 10dot, the height of the first printing data matrix is 2dot, the height of the second printing data matrix is 8dot, and the height of the third printing data matrix is 2dot.

When the number of feathering points is equal to one half of the number of the nozzles, the second printing data matrix does not exist.

For example, in the embodiment, the number of the nozzles in the pass is 18, when the number of feathering points is 9dot and the number of paper feeding point is 9dot, the height of the first printing data matrix is 9dot, the height of the third printing data matrix is 9dot, and the second printing data matrix does not exist.

When the serial number of the abnormal nozzle is less than or equal to the number of feathering points, based on the serial number of the abnormal nozzle, the first data of the abnormal nozzle can be obtained from the second printing data matrix corresponding to the m-th paper feeding process.

Based on the position information of the compensation nozzle, the second data corresponding to the compensation nozzle can be obtained from the second printing data matrix corresponding to the (m−1)-th paper feeding process. A logical OR operation is performed between the first data corresponding to the abnormal nozzle and the second data of the corresponding compensation nozzle to obtain the actual printing data of the compensation nozzle.

Figure 15:
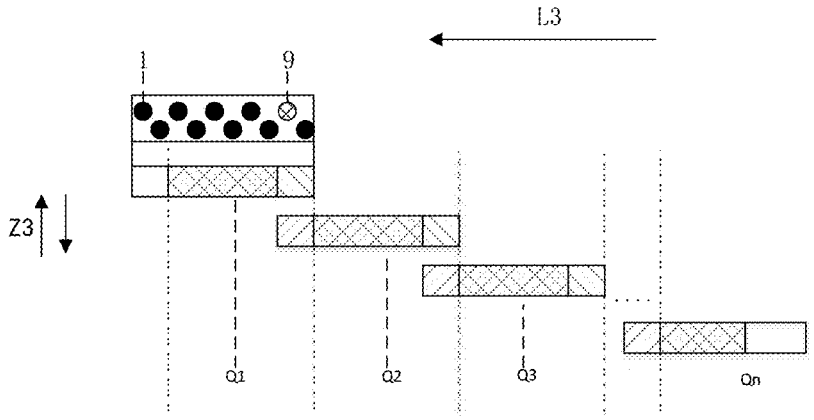
FIG. 15 is a schematic view showing the compensation of the abnormal nozzle of the method of FIG. 14.

Referring to FIG. 15, the number of the nozzles in the inkjet head is 10; when the number of feathering points is 2dot, the number of paper feeding points is 6dot, and the serial number of the abnormal nozzle is 9, then the serial number of the compensation nozzle for the first data corresponding to the abnormal nozzle is 1. The paper feeding direction is L3 as shown in FIG. 15, the moving direction of the inkjet head is Z3 as shown in FIG. 15, and the first data of the NO. 9 nozzle obtained in the second printing data matrix corresponding to the first paper feeding process Q1 is:

$$SrcData_1[20]=\{S1,S2,S3,S4,S5,S6,S7,S8,S9,S10,S11,S12,S13,S14,S15,S16,S17,S18,S19,S20\}.$$

The second data of the NO. 1 nozzle obtained in the second printing data matrix corresponding to the second paper feeding process Q2 is:

$$DstData_2[20]=\{0,1,2,0,3,2,3,0,1,2,0,0,1,3,2,0,3,0,2,1\}.$$

The ink holding data in $DstData_2$ for compensating $SrcData_1$ includes $DstData_2[1]=0$, $DstData_2[4]=0$, $DstData_2[8]=0$, $DstData_2[11]=0$ $DstData_2[12]=0$, $DstData_2[16]=0$, and $DstData_2[18]=0$.

The following operation is performed between each data element of $SrcData_1$ and the corresponding data element of $DstData_2$.

$$DstData_{2'}(k)=SrcData_1(k)\otimes DstData_2(k)k=1,2,\ldots,n.$$

Through the above operation, the actual printing data $DstData_{2'}$ of the compensation nozzle of the NO. 1 nozzle in the second paper feeding process Q2 is:

$$DstData_{2'}[20]=\{S1,1,2,S4,3,2,3,S8,1,2,S11,S12,1,3,2,S16,3,S18,2,1\}$$

In the second paper feeding process Q2, the NO. 1 nozzle performs the printing according to the data in DstData2'. The part of data in the NO. 9 nozzle in the first paper feeding process Q1 is compensated by the NO. 1 nozzle in the second paper feeding process Q2, thus, broken lines or blank spaces in the printed image caused by the abnormal nozzle can be avoided. The other parts of the method for compensating the abnormal nozzle of the embodiment 2 is the same as that provided in the best mode or the embodiment 1; for detailed illustration of Embodiment 2, please refer to the description of the best mode or the embodiment 1.

Embodiment 3

Figure 16:
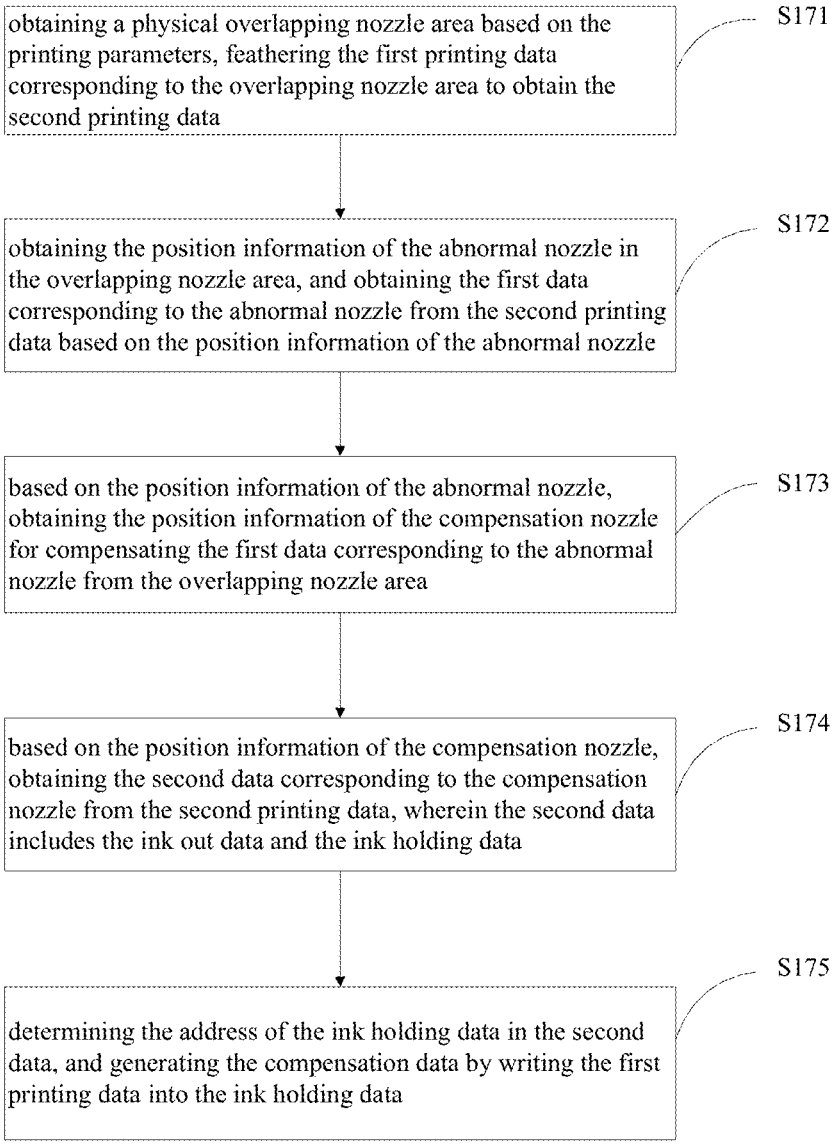
FIG. 16 is a flow chart of a compensation method for nozzle abnormality of an inkjet printer in accordance with a third embodiment of the present invention.

Referring to FIG. 16, in an embodiment, the printing overlapping area is formed by an overlapping nozzle area of the two adjacent inkjet heads (that is, printed by plurality inkjet heads arranged side by side). The abnormal nozzle is in the overlapping nozzle area. The printing parameters include a first nozzle number in the overlapping nozzle area and a second nozzle number in a single inkjet head. The method of the embodiment includes steps as follows.

In step S171, obtaining a physical overlapping nozzle area based on the printing parameters, feathering the first printing data corresponding to the overlapping nozzle area to obtain the second printing data.

In step S172, obtaining the position information of the abnormal nozzle in the overlapping nozzle area, and obtaining the first data corresponding to the abnormal nozzle from the second printing data based on the position information of the abnormal nozzle.

In step S173, based on the position information of the abnormal nozzle, obtaining the position information of the compensation nozzle for compensating the first data corresponding to the abnormal nozzle from the overlapping nozzle area.

In step S174, based on the position information of the compensation nozzle, obtaining the second data corresponding to the compensation nozzle from the second printing data, wherein the second data includes the ink out data and the ink holding data.

In step S175, determining the address of the ink holding data in the second data, and generating the compensation data by writing the first printing data into the address of the ink holding data.

Figure 17:
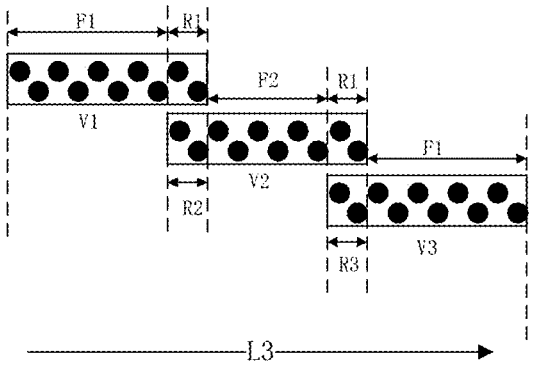
FIG. 17 is a schematic view of inkjet heads of the method of FIG. 16.

In some embodiments, supposed that the number of the inkjet heads is n. For the m-th inkjet head, when m=1, the first inkjet head includes one overlapping nozzle area which is marked as a first overlapping nozzle area; the first inkjet head further includes a first non-overlapping nozzle area; the nozzle number corresponding to the first overlapping nozzle area is marked as a first overlapping nozzle number, the nozzle number corresponding to the first non-overlapping nozzle is marked as a first non-overlapping nozzle number. When 1<m<n, the m-th inkjet head includes two overlapping nozzle areas which are respectively a second overlapping nozzle area and a third overlapping nozzle area; the second overlapping nozzle area and the third overlapping nozzle area are arranged according to an arrangement direction of the inkjet heads; the m-th inkjet head further includes a second non-overlapping nozzle area, and the nozzle number corresponding to the second overlapping nozzle area is marked as a second overlapping nozzle number, the nozzle number corresponding to the third overlapping nozzle area is marked as a third overlapping nozzle number. For the m-th inkjet head, when m=1, the first overlapping nozzle number of the first inkjet head is equal to the second overlapping nozzle number of the second inkjet head; when 1<m<n, the second overlapping nozzle number is equal to the third overlapping nozzle number of the (m−1)-th inkjet head. As shown in FIG. 17, in the embodiment, the printer includes 3 inkjet heads arranged in the direction L3 as shown in FIG. 17. Each inkjet head includes 10 nozzles, the first inkjet head V1 and the third inkjet head V3 are divided into a first overlapping area R1 and a first non-overlapping area F1. The nozzle number in the first overlapping area R1 is 2 and the nozzle number in the first non-overlapping area F1 is 8. The second inkjet head V2 is divided into a second overlapping area R2, a second non-overlapping area F2, and a third overlapping area R3. The nozzle number in the second overlapping area R2 and the third overlapping area R3 are both 2, and the nozzle number in the second non-overlapping area R3 is 6.

The inkjet heads are numbered according to an arrangement direction of the inkjet heads, and the nozzles in each inkjet head are numbered according to the arrangement direction of the inkjet heads to obtain the serial number of each nozzle. The serial number of the abnormal inkjet head having the abnormal nozzle and the serial number of the abnormal nozzle are determined based on the position information of the abnormal nozzle, and the serial number of the compensation inkjet head and the serial number of the compensation nozzle are determined according to the serial number of the abnormal inkjet head and the serial number of the abnormal nozzle.

For the X-th abnormal nozzle in the m-th inkjet head wherein X is a natural number greater than 0, when the serial number X of the abnormal nozzle is less than or equal to the second overlapping nozzle number of the m-th inkjet head, the compensation nozzle for compensating the printing data corresponding to the abnormal nozzle is located in the (m−1)-th inkjet head, and the serial number of the compensation nozzle can be obtained through the following formula:

$$Y=X+D+Z$$

wherein Y is the serial number of the compensation nozzle, X is the serial number of the abnormal nozzle, D is the second non-overlapping nozzle number of the (m−1)-th nozzle, and Z is the second overlapping nozzle number of the (m−1)-th nozzle.

When the serial number X of the abnormal nozzle is greater than or equal to the sum of the second overlapping nozzle number and the second non-overlapping nozzle number of the m-th inkjet head, the compensation nozzle for compensating the printing data corresponding to the abnormal nozzle is located in the (m+1)-th inkjet head, and the serial number of the compensation nozzle can be obtained through the following formula:

$$Y=X-T-U$$

wherein Y is the serial number of the compensation nozzle, X is the serial number of the abnormal nozzle, T is the second non-overlapping nozzle number of the m-th nozzle, and U is the third overlapping nozzle number of the m-th nozzle.

Figure 18:
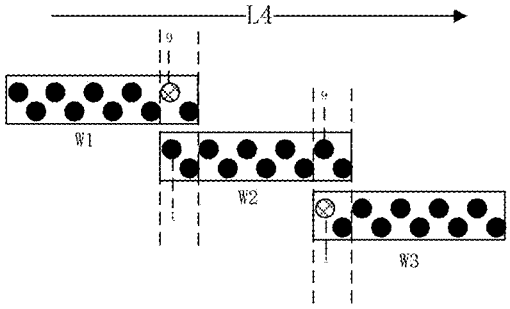
FIG. 18 is a schematic view showing how to determine the position of the abnormal nozzle of the method of FIG. 16.

Referring to FIG. 18, the arrangement direction of the inkjet heads is L4 as shown in FIG. 18. The three inkjet heads includes the first inkjet head W1, the second inkjet head W2, and the third inkjet head W3. Each inkjet head has 10 nozzles, the first overlapping nozzle number of the first inkjet head W1 and the third inkjet head W3 is 2, the first non-overlapping nozzle number of the first inkjet head W1 and the third inkjet head W3 is 6, the second overlapping nozzle number of the second inkjet head W2 is 2, the second non-overlapping nozzle number of the second nozzle is 6, and the third overlapping nozzle number of the second inkjet head W2 is 2. When the abnormal nozzle is located in the NO. 9 hole in the first inkjet head W, the compensation nozzle is located in the NO. 1 hole in the second inkjet head W2; when the abnormal nozzle is located in the NO. 2 hole in the third inkjet head W3, the compensation nozzle is located in the NO. 9 hole in the second inkjet head W2.

For the X-th abnormal nozzle in the first inkjet head, when the X-th abnormal nozzle is located in the first overlapping area, a logical AND operation is performed between a first overlapping data matrix corresponding to the first overlapping area and a feathering data matrix to obtain a first overlapping feathering data matrix, the printing data corresponding to the first overlapping feathering data matrix is a first feathering data. A logical AND operation is performed between a second overlapping data matrix corresponding to the second overlapping area and the complementary data matrix to obtain a second overlapping complementary feathering data matrix, and the printing data corresponding to the second overlapping complementary data matrix is second feathering data. The first printing data matrix corresponding to the first printing data includes the first overlapping data matrix of the first inkjet head, the second overlapping data matrix of the second inkjet head. The first feathering data and the second feathering data form the second printing data.

The first data corresponding to the X-th abnormal nozzle is extracted from the first overlapping feathering data matrix, and the second data for compensating the X-th abnormal nozzle is extracted from the second overlapping complementary feathering data matrix. The actual printing data of the compensation nozzle can be obtained by performing operation between the first data and the second data.

Figure 19:
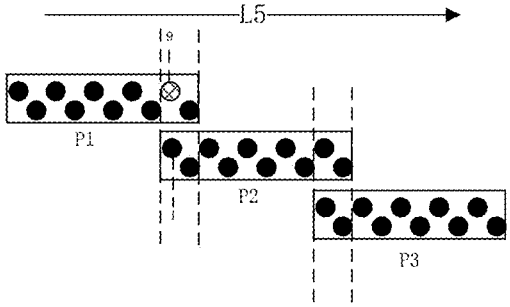
FIG. 19 is a schematic view showing the compensation of the abnormal nozzle of the method of FIG. 16.

Referring to FIG. 19, the arrangement direction of the inkjet heads is L5 as shown in FIG. 19. Each inkjet head has a first inkjet head P1, a second inkjet head P2, and a third inkjet head P3. Each inkjet head has 10 nozzles. The first overlapping nozzle number of the first inkjet head P1 and the third inkjet head P3 is 2, the second overlapping nozzle number of the second inkjet head P2 is 6, and the third non-overlapping nozzle number of the second inkjet head P2 is 2. The abnormal nozzle is the NO. 9 nozzle of the first inkjet head, the compensation nozzle for compensating the printing data of the abnormal nozzle is the NO. 1 nozzle of the second inkjet head. A logical AND operation is performed between the second overlapping data matrix corresponding to the second overlapping area and the feathering data matrix to obtain the second overlapping complementary feathering data matrix. The abnormal nozzle printing data corresponding to the abnormal NO. 9 nozzle is extracted from the first overlapping feathering data matrix, and the compensation nozzle printing data for compensating the abnormal nozzle is extracted from the second overlapping complementary feathering data matrix. A logical OR operation is performed between the abnormal nozzle printing data and the compensation nozzle printing data to obtain the actual printing data of the compensation nozzle.

The first data of the NO. 9 nozzle in the first inkjet head P1 is:

$$\mathrm{SrcData}_1[20]=\{S1,S2,S3,S4,S5,S6,S7,S8,S9,S10,S11,S12,S13,S14,S15,S16,S17,S18,S19,S20\}.$$

The second data of the NO. 1 nozzle in the second inkjet head P2 is:

$$\mathrm{DstData}_2[20]=\{0,1,2,0,3,2,3,0,1,2,0,0,1,3,2,0,3,0,2,1\}.$$

The ink holding data in $\mathrm{DstData}_2$ capable of compensating $\mathrm{SrcData}_1$ includes $\mathrm{DstData}_2[1]=0$, $\mathrm{DstData}_2[4]=0$, $\mathrm{DstData}_2[8]=0$, $\mathrm{DstData}_2[11]=0$, $\mathrm{DstData}_2[12]=0$, $\mathrm{DstData}_2[16]=0$, and $\mathrm{DstData}_2[18]=0$, wherein the remaining data in $\mathrm{DstData}_2$ is ink out data.

The following operation is performed between each data element in $\mathrm{SrcData}_1$ and the corresponding data element in $\mathrm{DstData}_2$.

$$\mathrm{DstData}_{2'}(k)=\mathrm{SrcData}_1(k)\otimes\mathrm{DstData}_2(k)k=1,2,\ldots,n.$$

Through the above operations, the actual printing data $\mathrm{DstData}_{2'}$ of the compensation nozzle of the NO. 1 nozzle in the second inkjet head P2 can be obtained:

$$\mathrm{DstData}_{2'}[20]=\{S1,1,2,S4,3,2,3,S8,1,2,S11,S12,1,3,2,S16,3,S18,2,1\}.$$

The NO. 1 nozzle in the second inkjet head P2 performs printing according to the data in DstData2', thus, the part of data in the printing data corresponding to the abnormal nozzle can be compensated by the NO. 1 nozzle, which avoids broken lines or blank spaces in the printed image caused by the abnormal nozzles in one area. The other parts of the embodiment 3 are the same as those provided in the best mode, the embodiment 1, or the embodiment 2; for detailed illustration of the embodiment 2, please refer to the description of the best mode, the embodiment 1, or the embodiment 2

Embodiment 4

Figure 20:
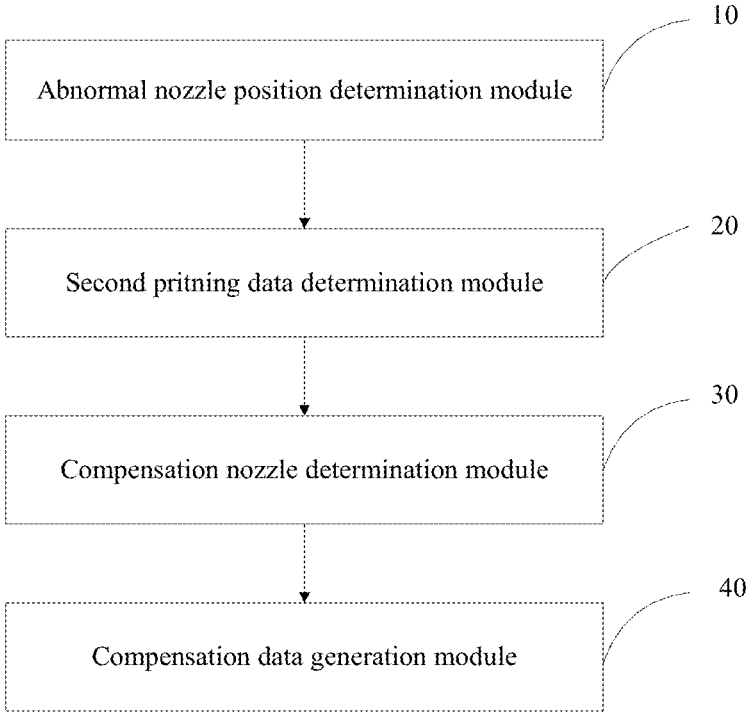
FIG. 20 is a schematic view of a compensation device for nozzle abnormality of an inkjet printer in accordance with a fourth embodiment of the present invention.

Referring to FIG. 20, the present invention further provides a compensation device for nozzle abnormality of an inkjet printer. The compensation device includes:

an abnormal nozzle position determination module 10, wherein the abnormal nozzle position determination module 10 is configured for determining position information of an abnormal nozzle in an inkjet head of the inkjet printer;

a compensation nozzle position determination module 20, wherein compensation nozzle position determination module 20 is configured for acquiring printing parameters, determining first data corresponding to the abnormal nozzle, and based on the position information of the abnormal nozzle and the printing parameters, determining position information of a compensation nozzle for compensating the first data of the abnormal nozzle; and a compensation data generation module 30, wherein the compensation data generation module 30 is configured for, based on the printing parameters, acquiring second data of the compensation nozzle in a normal printing data wherein the second data includes ink out data and ink holding data, determining an address of the ink holding data in the second data, and generating compensation data by writing the first data into the address of the ink holding data. The other parts of the embodiment 4 are the same as those provided in the best mode, the embodiment 1, the embodiment 2, or the embodiment 3. For detailed description of the embodiment 4, please refer to the description in the beset mode and the embodiments 1 to 3.

Embodiment 5

Figure 21:
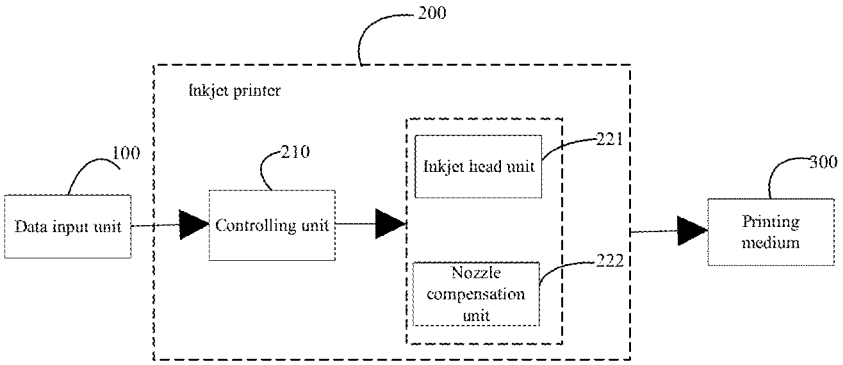
FIG. 21 is a schematic view of an inkjet printer in accordance with a fourth embodiment of the present invention.
Figure 22:
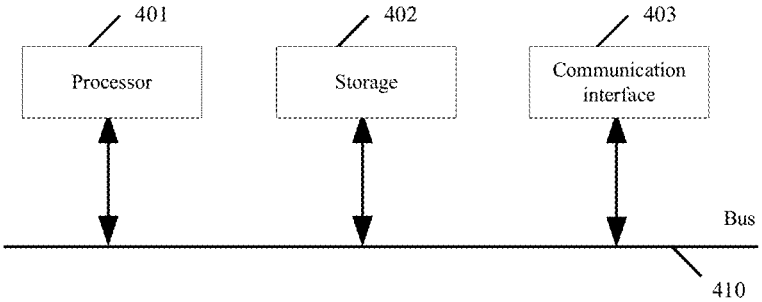
FIG. 22 is schematic view of a compensation apparatus for nozzle abnormality of an inkjet printer in accordance with a sixth embodiment of the present invention.

Referring to FIG. 21, the present invention provides an inkjet printer includes a controlling unit 210, an inkjet head unit 221, and a nozzle compensation unit 222. The controlling unit 210 is capable of controlling the nozzle compensation unit 222 such that an abnormal nozzle in the inkjet head unit 221 can be compensated by the nozzle compensation unit 222. The nozzle compensation unit 222 is the compensation device for nozzle abnormality of the inkjet printer as shown in FIG. 10. A data input unit 100 inputs the printing data into the controlling unit 210 of an inkjet printing equipment 200, and the controlling unit 210 is capable of being controlled by the printing data and thus the inkjet head unit 221 can jet ink onto a printing medium. However, after the inkjet printer keeps at work for a long time, the nozzle of the inkjet head may become abnormal due to the contamination of ink path, oblique jetting, ink sediment, dust, and moisture. The abnormality of the nozzle including blocking, blurring, lack of ink and so on causes broken lines or blank spaces in the printed image. In order to solve the above problem such as broken lines or blank spaces on the printed image, the inkjet printing equipment 200 of the present invention is configured with a nozzle compensation unit 222 for compensating the abnormal nozzle of the inkjet head unit 221. The other parts of the embodiment 5 are the same as those provided in the best mode, the embodiment 1, or the embodiment 2. For detailed description of the embodiment 5, please refer to the description in the beset mode and the embodiments 1 to 4.

INDUSTRIAL UTILITY

As mentioned above, the compensation method and device for nozzle abnormality of an inkjet printer and the inkjet printer provided in embodiments of the present invention not only overcome the problem that the quality of the printed image is poor due to the abnormal nozzle, but also reduce the maintenance cost of the inkjet head.

It should be clear that the present invention is not limited to the specific configurations and processes described above and shown in the drawing. For simplicity, detailed description of known methods is omitted here. In the above embodiments, several specific steps are described and shown as examples. However, the method of the present invention is not limited to the specific steps described and shown. Those skilled in the art can make various changes, modifications and additions, or change the order between the steps within the spirit of the present invention.

What mentioned above are only the embodiments of the present invention, which are not to limit the scope of the patent of the present invention. Any equivalent structure or equivalent transformation of the procedure made with the specification and the pictures attached of the present invention, or directly or indirectly using the specification and the pictures attached of the present invention into other relevant technical fields, is included in the scope of the patent protection of the present invention.

What is claimed is:

1. A compensation method for nozzle abnormality of an inkjet printer, comprising steps of:

determining position information of an abnormal nozzle in an inkjet head;

acquiring printing parameters, determining first data corresponding to the abnormal nozzle, and based on the position information of the abnormal nozzle and the printing parameters, determining position information of a compensation nozzle for compensating the first data corresponding to the abnormal nozzle; and acquiring second data of the compensation nozzle in a normal printing state based on the printing parameters which comprise ink out data and ink holding data, determining an address of the ink holding data, and generating compensation data by writing the first data into the address of the ink holding data, wherein the ink out data is data which are used to drive the inkjet head to eject ink; when the inkjet head acquires the ink out data, the ink is ejected; and the ink holding data is data which do not drive the inkjet head to eject the ink; when the inkjet head acquires the ink holding data, no ink is ejected;

wherein the printing parameters comprise a relative displacement between a printing medium and the inkjet head, the number of the nozzle, and printing times of a first shuttle scanning printing;

wherein the compensation method further comprises steps of: defining the printing times of the first shuttle scanning printing to be R wherein R is an integer greater than 2 and the inkjet head comprises R groups of the nozzles; when a v-th group of the nozzles comprises one or more abnormal nozzles, selecting one or more nozzles from remaining R-1 groups of the nozzles corresponding to the one or more abnormal nozzles as alternative compensation nozzles, and selecting the compensation nozzles from the alternative compensation nozzles to compensate the abnormal nozzles, wherein each abnormal nozzle corresponds to at least one compensation nozzle and v is an integer greater than 1.

2. A compensation method for nozzle abnormality of an inkjet printer, comprising steps of:

determining position information of an abnormal nozzle in an inkjet head;

acquiring printing parameters, determining first data corresponding to the abnormal nozzle, and based on the position information of the abnormal nozzle and the printing parameters, determining position information of a compensation nozzle for compensating the first data corresponding to the abnormal nozzle; and acquiring second data of the compensation nozzle in a normal printing state based on the printing parameters which comprise ink out data and ink holding data, determining an address of the ink holding data, and generating compensation data by writing the first data into the address of the ink holding data, wherein the ink out data is data which are used to drive the inkjet head to eject ink; when the inkjet head acquires the ink out data, the ink is ejected; and the ink holding data is data which do not drive the inkjet head to eject the ink; when the inkjet head acquires the ink holding data, no ink is ejected;

wherein the printing parameters comprise a relative displacement between a printing medium and the inkjet head, the number of the nozzle, and printing times of a first shuttle scanning printing;

wherein acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle comprises steps of:

defining a parameter P as the printing times of the first shuttle scanning printing, which indicates each block of image is formed by P times of covering printing, wherein P is an integer equal to or greater than 2; defining X as a current printing index, which refers to current printing times counted from a beginning of a printing, performing calculation to determine whether all the abnormal nozzles are in a printing range of the P times of printing comprising a current printing; taking one of the abnormal nozzles as a 1st nozzle, a beginning printing position of an X-th printing as $S_x$ which is equal to the relative displacement between the printing medium and the inkjet head in previous X times of printing, a newly-increased covering distance on the printing medium of the X-th printing as $h_x$, and a height of the inkjet head as H, then a newly-increased covering range of the X-th printing being $[S_x+H-h_x, S_x+H]$; taking the distance between the 1st nozzles as W in the direction, along which the said nozzle has a relative increasing displacement against the printing medium, initial positions of an (x+0)-th, an (X+1)-th, . . . an (X+P−1)-th printing being respectively $S_x$, $S_{x+1}$, . . . , $S_{X+P-1}$, and the newly-increased covering range of each printing being $[S_x+H-h_x, S_x+H]$, and the printing positions of the 1st nozzle being respectively $S_x+W$, $S_{x+1}+W$, . . . , $S_{X+P-1}+W$; if the printing position of the 1st nozzle on the printing medium is not within the newly-increased covering range, stopping storing a first mapping relationship; and if the printing position of the 1st nozzle on the printing medium is within the newly-increased covering range and is different from the stored first mapping relationship, storing the first mapping relationship, and extracting the first data of the 1st nozzle, wherein the first mapping relationship comprises the corresponding printing index and the printing position of the 1st nozzle on the printing medium;

wherein before acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle, the method comprises:

acquiring the printing parameters, and feathering the first data corresponding to the printing parameters to obtain second printing data, wherein the second printing data comprises the first data and the second data;

wherein the printing parameters comprise a first feathering amplitude, and feathering the first data corresponding to the printing parameters to obtain the second printing data comprises steps of:

obtaining printing times of a second shuttle scanning printing based on the printing times of the first shuttle scanning printing and the first feathering amplitude, wherein the printing times of the second shuttle scanning printing is greater than that of the first shuttle scanning printing; and feathering to-be-printed first printing data to obtain the second printing data based on the printing times of the second shuttle scanning printing, wherein a number of elements of the ink holding data in the second printing data is greater than that of elements of the ink holding data in the first printing data;

wherein acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle comprises steps of:

if the current printing comprises the abnormal nozzle, marking the abnormal nozzle as the first abnormal nozzle;

based on the printing parameters and a covering times of a same area on the printing medium in the current printing, acquiring a feeding distance covering the printing medium in the current printing and a compensation range for the first abnormal nozzle, building a second mapping relationship between a position of the first abnormal nozzle, a printing position of the first abnormal nozzle on the printing medium, and the first data corresponding to the first abnormal nozzle;

if the printing position of the first abnormal nozzle on the printing medium is outside a current printing range of the inkjet head, stopping storing the second matting relationship; and if the printing position of the first abnormal nozzle on the printing medium is within the current printing range of the inkjet head, storing the second mapping relationship and backing up the first data.

3. The method as defined in claim 2, wherein acquiring the second data of the compensation nozzle in the normal printing state based on the printing parameters which comprise the ink out data and the ink holding data, determining the address of the ink holding data, and generating the compensation data by writing the first data into the address of the ink holding data comprises steps of:

searching the stored second mapping relationship to determine whether there is at least one of the abnormal nozzles except the first abnormal nozzle having a printing position thereof in the printing range of the current printing medium; and if there is, marking the corresponding abnormal nozzle as the second abnormal nozzle and acquiring printing position information of the second abnormal nozzle on the printing medium based on the second mapping relationship, performing calculation to obtain the compensation nozzle in the printing range which covers the current printing medium, and generating the compensation data by writing the backup printing data of the second abnormal nozzle in the second mapping relationship into the address of the ink holding data of the compensation nozzle.

4. A compensation method for nozzle abnormality of an inkjet printer, comprising steps of:

determining position information of an abnormal nozzle in an inkjet head;

acquiring printing parameters, determining first data corresponding to the abnormal nozzle, and based on the position information of the abnormal nozzle and the printing parameters, determining position information of a compensation nozzle for compensating the first data corresponding to the abnormal nozzle; and acquiring second data of the compensation nozzle in a normal printing state based on the printing parameters which comprise ink out data and ink holding data, determining an address of the ink holding data, and generating compensation data by writing the first data into the address of the ink holding data, wherein the ink out data is data which are used to drive the inkjet head to eject ink; when the inkjet head acquires the ink out data, the ink is ejected; and the ink holding data is data which do not drive the inkjet head to eject the ink; when the inkjet head acquires the ink holding data, no ink is ejected;

wherein the printing parameters comprise a relative displacement between a printing medium and the inkjet head, the number of the nozzle, and printing times of a first shuttle scanning printing;

wherein acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle comprises steps of:

defining a parameter P as the printing times of the first shuttle scanning printing, which indicates each block of image is formed by P times of covering printing, wherein P is an integer equal to or greater than 2; defining X as a current printing index, which refers to current printing times counted from a beginning of a printing, performing calculation to determine whether all the abnormal nozzles are in a printing range of the P times of printing comprising a current printing; taking one of the abnormal nozzles as a 1st nozzle, a beginning printing position of an X-th printing as $S_x$ which is equal to the relative displacement between the printing medium and the inkjet head in previous X times of printing, a newly-increased covering distance on the printing medium of the X-th printing as $h_x$, and a height of the inkjet head as H, then a newly-increased covering range of the X-th printing being $[S_x+H-h_x, S_x+H]$; taking the distance between the 1st nozzles as W in the direction, along which the said nozzle has a relative increasing displacement against the printing medium, initial positions of an (x+0)-th, an (X+1)-th, an (X+P−1)-th printing being respectively $S_x, S_{x+1}, \ldots, S_{X+P-1}$, and the newly-increased covering range of each printing being $[S_x+H-h_x, S_x+H]$, and the printing positions of the 1st nozzle being respectively $S_x+W, S_{x+1}+W, \ldots, S_{X+P-1}+W$; if the printing position of the 1st nozzle on the printing medium is not within the newly-increased covering range, stopping storing a first mapping relationship; and if the printing position of the 1st nozzle on the printing medium is within the newly-increased covering range and is different from the stored first mapping relationship, storing the first mapping relationship, and extracting the first data of the 1st nozzle, wherein the first mapping relationship comprises the corresponding printing index and the printing position of the 1st nozzle on the printing medium;

wherein before acquiring the printing parameters, determining the first data corresponding to the abnormal nozzle, and based on the position information of the abnormal nozzle and the printing parameters, determining the position information of the compensation nozzle for compensating the first data corresponding to the abnormal nozzle, the method comprises:

acquiring the printing parameters, and feathering the first data corresponding to the printing parameters to obtain second printing data, wherein the second printing data comprises the first data and the second data;

wherein the printing parameters comprise a first nozzle number of two adjacent overlapping nozzle areas and a second nozzle number of a single inkjet head wherein acquiring the printing parameters and feathering the first data corresponding to the printing parameters to obtain the second data comprises:

based on the first printing data corresponding to the overlapping nozzle area, acquiring feathering data corresponding to a feathering template and complementary data of the feathering data, performing a logical AND operation between the first printing data and the feathering data to obtain first feathering data, performing a logical AND operation between the first printing data and the complementary feathering data to obtain second feathering data, and combining the first feathering data and the second feathering data to form the second printing data.

5. The method as defined in claim 4, wherein the complementary feathering data is obtained through the following formula:

$$P'=E-P;$$

wherein E is data corresponding to a unit matrix of which elements are 1, P' is the complementary feathering data, and P is the feathering data.

6. The method of claim 5, wherein by defining the number of the nozzles to be n, for an m-th inkjet head, when m=1, the first inkjet head comprises one overlapping nozzle area which is marked as a first overlapping nozzle area; the first inkjet head further comprises a first non-overlapping nozzle area; a nozzle number corresponding to the first overlapping nozzle are is marked as a first overlapping nozzle number, a nozzle number corresponding to the first non-overlapping nozzle is marked as a first non-overlapping nozzle number; when 1<m<n, the m-th inkjet head comprises two overlapping nozzle areas which are respectively a second overlapping nozzle area and a third overlapping nozzle area, a nozzle number corresponding to the second overlapping nozzle area is marked as a second overlapping nozzle number, and a nozzle number corresponding to the third overlapping nozzle area is marked as a third overlapping nozzle number;

for an X-th abnormal nozzle in the m-th inkjet head wherein X is a natural number greater than 0, when a serial number X of the abnormal nozzle is less than or equal to the second overlapping nozzle number of the m-th inkjet head, the compensation nozzle for compensating the printing data corresponding to the abnormal nozzle is located in an (m−1)-th inkjet head, and a serial number of the compensation nozzle is obtained through the following formula:

$$Y=X+D+Z;$$

wherein Y is the serial number of the compensation nozzle, X is the serial number of the abnormal nozzle, D is the second non-overlapping nozzle number of the (m−1)-th nozzle, and Z is the second overlapping nozzle number of the (m−1)-th nozzle;

when the serial number X of the abnormal nozzle is greater than or equal to a sum of the second overlapping nozzle number and the second non-overlapping nozzle number of the m-th inkjet head, the compensation nozzle for compensating the printing data corresponding to the abnormal nozzle is located in an (m+1)-th inkjet head, and the serial number of the compensation nozzle can be obtained through the following formula:

$$Y=X-T-U;$$

wherein Y is the serial number of the compensation nozzle, X is the serial number of the abnormal nozzle, T is the second non-overlapping nozzle number of the m-th nozzle, and U is the second overlapping nozzle number of the m-th nozzle.

* * * * *